US009207558B2

(12) United States Patent
Hasegawa et al.

(10) Patent No.: US 9,207,558 B2
(45) Date of Patent: Dec. 8, 2015

(54) IMAGE FORMING APPARATUS

(71) Applicant: CANON KABUSHIKI KAISHA, Tokyo (JP)

(72) Inventors: Hideaki Hasegawa, Suntou-gun (JP); Motoki Adachi, Ashigarakami-gun (JP); Takayoshi Kihara, Mishima-shi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/894,823

(22) Filed: May 15, 2013

(65) Prior Publication Data

US 2013/0308969 A1 Nov. 21, 2013

(30) Foreign Application Priority Data

May 17, 2012 (JP) ..... 2012-113190

(51) Int. Cl.
*G03G 15/02* (2006.01)
*G03G 15/043* (2006.01)
*G03G 15/00* (2006.01)

(52) U.S. Cl.
CPC ..... *G03G 15/0266* (2013.01); *G03G 15/043* (2013.01); *G03G 15/5033* (2013.01)

(58) Field of Classification Search
CPC ..... G03G 15/0266; G03G 15/043; G03G 15/5033
USPC ..... 399/50, 51, 26, 32
See application file for complete search history.

(56) References Cited

U.S. PATENT DOCUMENTS

| | | | | |
|---|---|---|---|---|
| 6,785,482 | B2 * | 8/2004 | Ogata et al. | 399/55 |
| 7,844,200 | B2 * | 11/2010 | Kanai et al. | 399/128 |
| 7,848,679 | B2 * | 12/2010 | Kanai et al. | 399/128 |
| 2012/0213552 | A1 * | 8/2012 | Iwasaki | 399/174 |
| 2012/0230705 | A1 * | 9/2012 | Shimura et al. | 399/26 |
| 2012/0300009 | A1 * | 11/2012 | Toyoizumi et al. | 347/118 |
| 2013/0108290 | A1 * | 5/2013 | Funatani et al. | 399/43 |
| 2013/0141511 | A1 * | 6/2013 | Hasegawa et al. | 347/224 |
| 2013/0148991 | A1 * | 6/2013 | Sakata | 399/48 |
| 2013/0279927 | A1 * | 10/2013 | Kihara et al. | 399/50 |
| 2014/0072318 | A1 * | 3/2014 | Hayakawa | 399/51 |
| 2014/0147139 | A1 * | 5/2014 | Hasegawa et al. | 399/50 |
| 2014/0178087 | A1 * | 6/2014 | Suzuki et al. | 399/50 |

FOREIGN PATENT DOCUMENTS

| | | | |
|---|---|---|---|
| JP | 8-171260 | A | 7/1996 |
| JP | 2002-296853 | A | 10/2002 |

* cited by examiner

*Primary Examiner* — David Gray
*Assistant Examiner* — Carla Therrien
(74) *Attorney, Agent, or Firm* — Canon USA, Inc. IP Division

(57) ABSTRACT

An image forming apparatus includes photosensitive drums, charging devices, an exposure unit configured to expose surfaces of photosensitive drums to generate a non-image portion potential and expose the surfaces to generate an image portion potential, developing members configured to make a developer adhere to an area where the image portion potential is generated to form a developer image on the photosensitive drums, a control unit configured to control an intensity of the charging voltage, and an acquisition unit configured to acquire thicknesses of photosensitive layers of the respective plurality of photosensitive drums, wherein the control unit is configured to set the intensity of a charging voltage applied to the common charging devices according to a maximum thickness among the thicknesses acquired by the acquisition unit, and individually control the output of the first laser power for the photosensitive drum according to surface potentials of the charged photosensitive drums.

11 Claims, 18 Drawing Sheets

IMAGE FORMING APPARATUS

BACKGROUND

1. Field of Disclosure

Aspects of the present invention relate to an image forming apparatus.

2. Description of the Related Art

Image forming apparatuses using an electrophotographic method such as a copying machine and a printer, conventionally employ contact charging devices because of advantages such as low ozone emission and low power. Contact charging devices charge a photosensitive drum by applying a voltage to a charging member in contact with the photosensitive drum. In particular, contact charging devices of a roller charging method, using a charging roller as a charging member, are preferred in terms of charging stability and are in widespread use. With a contact charging device of the roller charging method, the surface potential of a photosensitive drum starts to increase when a voltage higher than or equal to a certain level (charging start voltage Vth) is applied to the charging roller. The surface potential of the photosensitive drum thereafter increases linearly with a gradient of one with respect to the applied voltage. To obtain a photosensitive drum surface potential (Vd) necessary for electrophotography, a direct-current (DC) voltage of Vd+Vth needs to be applied to the charging member.

As a method for improving uniformity of the surface potential of the photosensitive drum in a DC charging system, the following method has been discussed (see Japanese Patent Application Laid-Open No. 8-171260). A primary charging device once charges the photosensitive drum to a potential higher than or equal to a non-image portion potential (Vd) necessary for image formation. An exposure unit (post-exposure unit) arranged in a position after the primary charging and before development emits weak light to expose the potential of the photosensitive drum, thereby attenuating (lowering) the surface potential. A target non-image portion potential (Vd) can be obtained by such a potential control method.

Using the DC charging system, the charging start voltage Vth varies depending on the thickness of a photosensitive layer of the photosensitive drum. As the photosensitive drum is shaven, the thickness of the photosensitive drum is reduced and the non-image portion potential (Vd) increases. A method for calculating the thickness of a photosensitive drum from information about any of the number of passed sheets, the number of rotations of the photosensitive drum, and the application time of a charging voltage, has thus been discussed to control the amount of exposure to make latent image potential settings constant (see Japanese Patent Application Laid-Open No. 2002-296853). According to such a method, the range between the maximum amount of light for forming an image portion potential (Vl) and the minimum amount of light for generating the non-image portion potential (Vd) can be changed based on the calculated thickness of the photosensitive drum to stably reproduce image density, line widths, and gradation.

According to the foregoing technique, a color image forming apparatus including a plurality of photosensitive drums can control the amounts of exposure of non-image portions on the respective photosensitive drums according to the thicknesses of the photosensitive drums. As a result, constant non-image portion potentials (Vd) can be obtained even if a common voltage value is applied to the charging rollers. In addition, the amounts of exposure of image portions for generating image portion potentials (Vl) can also be controlled based on the thicknesses of the photosensitive drums. As s a result, the charging voltages of the plurality of photosensitive drums and developing voltages applied to developing devices for developing electrostatic latent images on the respective photosensitive drums can be shared. The image forming apparatus can thus be reduced in size and cost.

However, an imaging forming apparatus that uses the DC charging system and performs non-image portion exposure (background exposure) on a surface-charged photosensitive drum has had the following problem. If the photosensitive drum is repeatedly subjected to a not-optimized amount of background exposure over a long period of use, the sensitivity of the photosensitive drum can vary greatly to cause an image defect such as a drop in image density. If the surface of the photosensitive drum is charged with a constant charging voltage, a primary charging potential increases because of a decrease in thickness associated with the use. To maintain a constant non-image portion voltage (Vd), the amount of background exposure is controlled to increase. In such a case, the amount of background exposure would become extremely large after a long period of use as compared to the initial use state of the photosensitive drum.

To suppress the sensitivity drop of the photosensitive drum due to optical fatigue, the amount of background exposure is desirably suppressed to a low level. For that purpose, the voltage applied to the charging device for charging the photosensitive drum is also desirably adjusted to be as low as possible. A color image forming apparatus including a plurality of photosensitive drums may include a plurality of charging devices for the respective photosensitive drums so that different charging voltages can be applied to the charging devices according to the thicknesses of the photosensitive drums. This can suppress the charging voltages for charging the respective photosensitive drums to a low level. In such a case, however, voltage circuits need to be prepared for the respective photosensitive drums. For example, a plurality of power supplies for applying voltages to the charging devices is needed. Accordingly, improvement is demanded in terms of miniaturization and cost reduction of the image forming apparatus.

SUMMARY

The present disclosure is directed to a color image forming apparatus configured to charge a plurality of photosensitive drums having different thicknesses by applying a common charging voltage to respective charging devices. Exposures individually set for the respective photosensitive drums are performed on non-image portions of the photosensitive drums to form an appropriate non-image portion voltage (Vd) on each of the plurality of photosensitive drums.

With such a configuration, the image forming apparatus can suppress the intensity of the common charging voltage applied to the charging devices to a low level, thereby suppressing a drop in the sensitivity of the photosensitive drums while generating stable surface potentials on the photosensitive drums.

According to an aspect of the present disclosure, an image forming apparatus includes a plurality of photosensitive drums, a plurality of charging devices configured to charge the respective corresponding photosensitive drums, a charging voltage being applied to the plurality of charging devices from a common power supply, an exposure unit configured to expose surfaces of the plurality of photosensitive drums charged by the charging devices with a first laser power to generate a non-image portion potential, and expose the surfaces with a second laser power to generate an image portion potential, a plurality of developing members configured to make a developer adhere to an area where the image portion potential is generated to form a developer image on the respective corresponding photosensitive drums, a developing voltage being applied to the plurality of developing members from a common power supply, a control unit configured to control an intensity of the common charging voltage applied to the plurality of charging devices and output of the laser powers of the exposure unit, and an acquisition unit configured to acquire thicknesses of photosensitive layers of the respective plurality of photosensitive drums, wherein the control unit is configured to set the intensity of the common charging voltage applied to the plurality of charging devices according to a maximum thickness among the plurality of thicknesses acquired by the acquisition unit, and individually control the output of the first laser power for each of the photosensitive drums according to surface potentials of the respective charged photosensitive drums.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the disclosure.

DESCRIPTION OF THE EMBODIMENTS

Various exemplary embodiments, features, and aspects of the invention will be described in detail below with reference to the drawings.

The dimensions, materials, shapes, and relative arrangement of components described in the following exemplary embodiments are subject to appropriate modifications depending on the configuration and various conditions of apparatuses to which the exemplary embodiments of the present invention are applied. The scope of an exemplary embodiment of the present invention is not limited to the following exemplary embodiments.

(1-1) Description of Overall Schematic Configuration of Image Forming Apparatus

Figure 2:
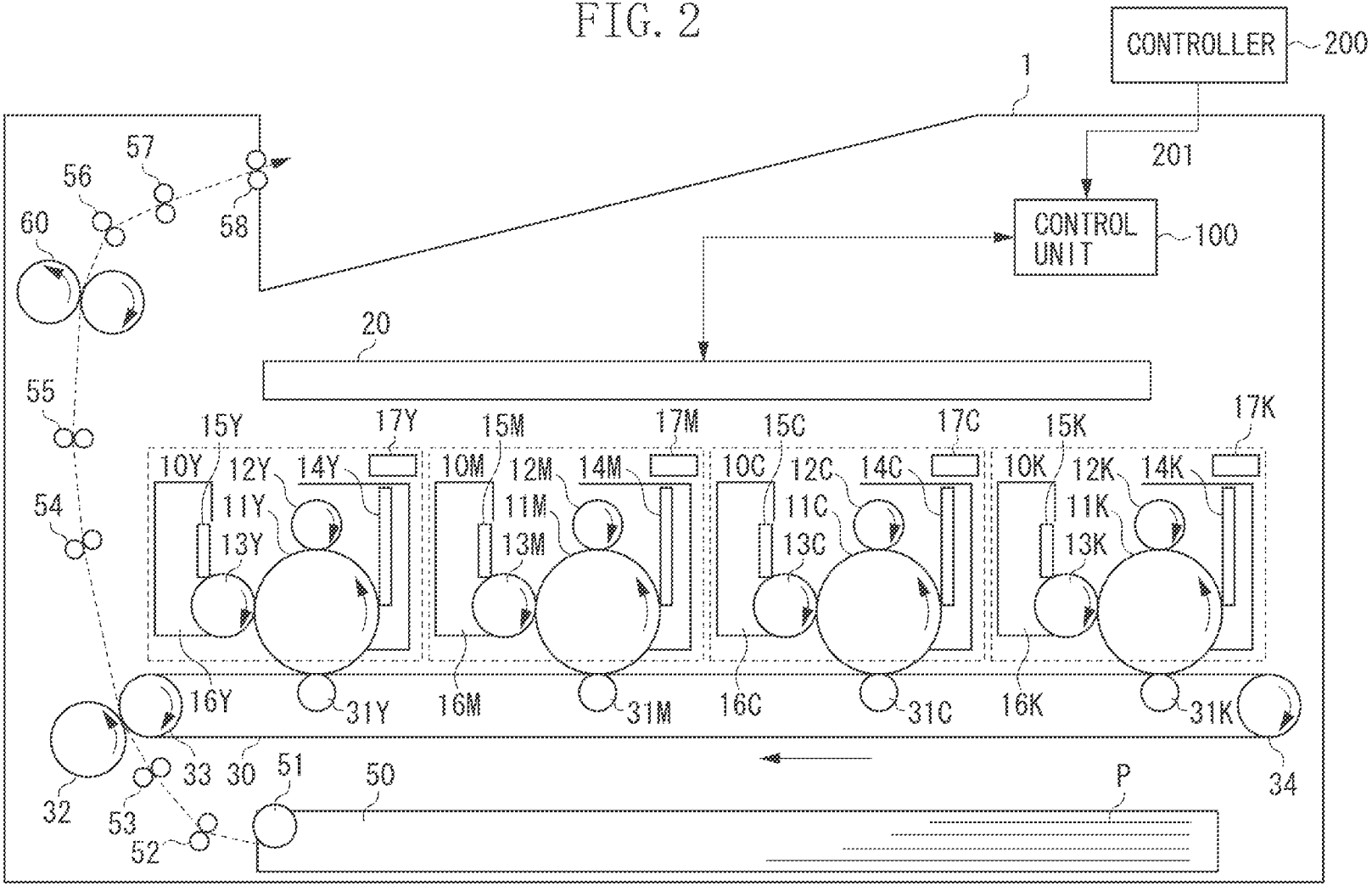
FIG. 2 is a schematic sectional view of an image forming apparatus according to the exemplary embodiment of the present invention.

FIG. 2 is a schematic sectional view of an image forming apparatus according to a first exemplary embodiment of the present invention. The image forming apparatus 1 according to the exemplary embodiment of the present invention is a laser beam printer using an electrophotographic process. A printer control unit (hereinafter, control unit) 100 is connected to a printer controller (external host apparatus) 200 via an interface 201. The image forming apparatus 1 forms an image corresponding to image data (electrical image information) input from the printer controller (hereinafter, controller) 200 on a recording medium or sheet P to output an image formation product. The control unit 100 is a unit for controlling an operation of the image forming apparatus 1, and exchanges various electrical information signals with the controller 200. The control unit 100 also processes electrical information signals input from various process devices and sensors, processes command signals to be sent to various process devices, and performs a predetermined initial sequence control and a predetermined image forming sequence control. Examples of the controller 200 include a host computer, a network, an image reader, and a facsimile apparatus. Examples of the recording medium P include recording paper, overhead projector (OHP) sheets, postcards, envelopes, and labels.

The image forming apparatus 1 illustrated in FIG. 2 includes four image forming units (process cartridges) 10Y, 10M, 10C, and 10K which are juxtaposed at regular distances in a lateral direction (generally horizontal direction) in a so-called tandem configuration. The suffixes Y, M, C, and K to the reference numerals of the process cartridges 10Y, 10M, 10C, and 10K indicate that developers of different colors are accommodated therein (toner images of different colors are formed). Y represents yellow, M magenta, C cyan, and K black. The process cartridges 10Y, 10M, 10C, and 10K have similar configurations. In the following description, the suffixes to the reference numerals of the process cartridges 10Y, 10M, 10C, and 10K as well as components included therein, and other corresponding components may be omitted as appropriate when a color does not need to be distinguished.

The process cartridges 10Y to 10K integrally include photosensitive drums 11Y to 11K, charging rollers 12Y to 12K, developing rollers 13Y to 13K, developing blades 15Y to 15K, and drum cleaners 14Y to 14K, respectively. The photosensitive drums 11 serve as image bearing members. The charging rollers 12 are charging units (charging devices) that uniformly charge the surfaces of the photosensitive drums 11 with a predetermined potential. The developing rollers 13 are developing units (developing members) that bear and convey nonmagnetic one-component toner (negative charging characteristic) to develop electrostatic latent images formed on the photosensitive drums 11 into developer images (toner images). The developing blades 15 are intended to make toner layers on the developing rollers 13 uniform. The drum cleaners 14 are intended to clean the surfaces of the photosensitive drums 11 after transfer. Not-illustrated driving units drive the photosensitive drums 11 to rotate in the directions of the arrows in the diagram at a surface moving speed of 120 mm/sec. The photosensitive drums 11 are formed by stacking a charge generation layer, a charge transport layer, and a surface layer on an aluminum element tube in succession. In the present exemplary embodiment, the charge generation layer, the charge transport layer, and the surface layer will be referred to collectively as a photosensitive layer.

The process cartridges 10Y to 10K have generally the same configuration except the toners contained in their respective developer containers 16Y to 16K. The process cartridges 10Y, 10M, 10C, and 10K form toner images of yellow (Y), magenta (M), cyan (C), and black (K), respectively. The process cartridges 10Y to 10K are configured to be detachably attached to a main body of the image forming apparatus 1. For example, each of the process cartridges 10Y to 10K each can be independently replaced when the toner in its developer container 16 is consumed.

The process cartridges 10Y to 10K include memories 17Y to 17K as storage units, respectively. Any type of memories may be used as the memories 17. Examples include a contact nonvolatile memory, a noncontact nonvolatile memory, and a volatile memory provided with a power supply. In the present exemplary embodiment, the process cartridges 10 include noncontact nonvolatile memories 17 as the storage units. The noncontact nonvolatile memories 17 include an antenna (not illustrated) serving as an information transmission unit on the memory side. The noncontact nonvolatile memories 17 can wirelessly communicate with the control unit 100 on the side of the main body of the image forming apparatus 1 to read and write information. In other words, the control unit 100 has functions as an information transmission unit on the apparatus main body side and a unit for reading and writing information from/to the memories 17. The memories 17 contain information about the respective photosensitive drums 11 in an original condition. Examples of the information include the thickness of a photosensitive layer in an original condition (initial thickness of the photosensitive layer) and sensitivity in an original condition (initial sensitivity). Such information is stored at the time of manufacturing. The photosensitive drums' information that varies in association with the use of the photosensitive drums 11 (information about the amounts of change in thickness and sensitivity of the photosensitive layers) can also be written and read when needed.

The developing rollers 13 serving as developing units (developing members) include a core and a conductive elastic body layer which is concentrically and integrally formed around the core. The developing rollers 13 are arranged generally in parallel with the photosensitive drums 11. The developing blades 15 are made of a thin metal plate of stainless steel. Free ends of the developing blades 15 are put in contact with the developing rollers 13 by a predetermined pressure force. The developing rollers 13 bear and convey toner frictionally charged to a negative polarity, to developing positions opposed to the respective photosensitive drums 11. The developing rollers 13 are configured to be put in contact with and separated from the photosensitive drums 11 by a not-illustrated contacting/separating mechanism. In an image forming step, the developing rollers 13 are put in contact with the photosensitive drums 11, and a DC bias voltage of approximately −300 V is applied to the cores of the developing rollers 13 as a development bias voltage.

The image forming apparatus 1 according to the present exemplary embodiment includes a laser exposure unit 20 serving as an exposure system. The laser exposure unit exposes the photosensitive drums 11 arranged in the respective process cartridges 10Y to 10K. The controller 200 inputs image information to the control unit 100 via the interface 201. The control unit 100 performs image processing on the image information, and inputs the resulting time-series electrical digital pixel signal to the laser exposure unit 20. The laser exposure unit 20 includes a laser output unit, a rotating polygonal mirror (polygon mirror), an fθ lens, and a reflecting mirror. The laser output unit outputs laser light that is modulated according to the input time-series electrical digital pixel signal. The laser exposure unit 20 performs main scanning exposure on the surfaces of the photosensitive drums 11 with laser light L. Such main scanning exposure and sub scanning effected by rotation of the photosensitive drums 11 form electrostatic latent images corresponding to the image information.

The charging rollers 12 serving as contact charging units include a core and a conductive elastic body layer which is concentrically and integrally formed around the core. The charging rollers 12 are arranged generally in parallel with the conductive drums 11, and put in contact with the conductive drums 11 by a predetermined pressure force against elasticity of the conductive elastic body layers. The cores are rotatably supported by bearings at both ends, so that the charging rollers 12 rotate to follow the rotation of the photosensitive drums 11. In the present exemplary embodiment, a charging bias voltage is applied to the cores of the charging rollers 12.

The image forming apparatus 1 according to the present exemplary embodiment includes an intermediate transfer belt 30 serving as a second image bearing member. The intermediate transfer belt 30 is arranged in contact with the photosensitive drums 11 of the process cartridges 10Y to 10K. A resin film having an electrical resistance (volume resistivity) of around $10^{11}$ to $10^{16}$ Ω·cm, formed in an endless shape with a thickness of 100 to 200 μm, is used as the intermediate transfer belt 30. Examples of the material of the intermediate transfer belt 30 include polyvinylidene difluoride (PVDF), nylon, polyethylene terephthalate (PET), and polycarbonate (PC). The intermediate transfer belt 30 is stretched across a driving roller 34 and a secondary transfer counter roller 33. A not-illustrated motor rotates the secondary transfer counter roller 33, whereby the intermediate transfer belt is driven to circulate at a process speed. Primary transfer rollers 31Y to 31K are each configured as a roller having a conductive elastic layer on its shaft. The primary transfer rollers 31Y to 31K are arranged substantially in parallel with the photosensitive drums 11Y to 11K. The primary transfer rollers 31Y to 31K are put in contact with the respective photosensitive drums 11Y to 11K by a predetermined pressure force with the intermediate transfer belt 30 therebetween. A DC bias voltage of positive polarity is applied to the shafts of the primary transfer rollers 31, whereby transfer electric fields are created.

The color toner images of the respective colors developed on the photosensitive drums 11 are conveyed to the primary transfer positions as the photosensitive drums 11 rotate further in the directions of the arrows. The toner images are primarily transferred to the intermediate transfer belt 30 in succession by the primary transfer electric fields created between the primary transfer rollers 31 and the photosensitive drums 11. Since the four color images are successively transferred to the intermediate transfer belt 30 in a superimposed manner, the four color toner images coincide in position. Primary transfer residual toners on the photosensitive drums 11 are cleaned by the drum cleaners 14.

To favorably perform the primary transfer step while constantly satisfying conditions such as a high transfer efficiency and a low retransfer rate, a positive bias supplied from a primary transfer bias power supply 701 (see FIG. 4) needs to be constantly controlled to an optimum value in consideration of the environment and parts characteristics. In the present exemplary embodiment, such a control is performed by a not-illustrated control unit.

The image forming apparatus 1 according to the present exemplary embodiment includes a sheet cassette 50, a pickup roller 51, conveyance rollers 52, and registration rollers 53 as a sheet conveyance system on a sheet feeding side. The sheet cassette 50 contains sheets P. The pickup roller 51 picks up and conveys a sheet P, which is a recording material stacked in the sheet cassette 50, at predetermined timing. The conveyance rollers 52 convey the sheet P dispensed by the pickup roller 51. The registration rollers 53 feed the sheet P to a secondary transfer position in time with an image forming operation.

After the four color toner images are primarily transferred to the intermediate transfer belt 30, the sheet P is conveyed from the registration rollers 53 in synchronization with the rotation of the intermediate transfer belt 30. A secondary transfer roller 32 having a similar configuration to that of the primary transfer roller 31 makes contact with the intermediate transfer belt 30 with the sheet P therebetween. A secondary transfer bias power supply 702 (see FIG. 4) applies a positive polarity bias to the secondary transfer roller 32 with the secondary transfer counter roller 33 as a counter electrode, whereby the four color toner images on the intermediate transfer belt 30 are secondarily transferred to the sheet P at a time. A not-illustrated charging brush in contact with the intermediate transfer belt 30 applies a bias to secondary transfer residual toner, whereby the secondary toner residual toner is given a charge of positive polarity. The secondary transfer residual toner is thus transferred to the photosensitive drums 11 at the primary transfer positions in the image forming step, and scraped and collected by the drum cleaners 14.

The sheet P to which the four color toner images are transferred is conveyed by conveyance rollers 54 and 55 to a known conventional fixing device 60. The fixing device 60 applies fixing processing to the unfixed toner images on the sheet P by heat and pressure, whereby the unfixed toner images are fixed to the sheet P. Sheet discharge rollers 56, 57, and 58 discharge the sheet P as a color-image-formed product from a discharge port onto a discharge tray at the top of the apparatus main body.

(1-2) Description of Laser Exposure Unit

Figure 11:
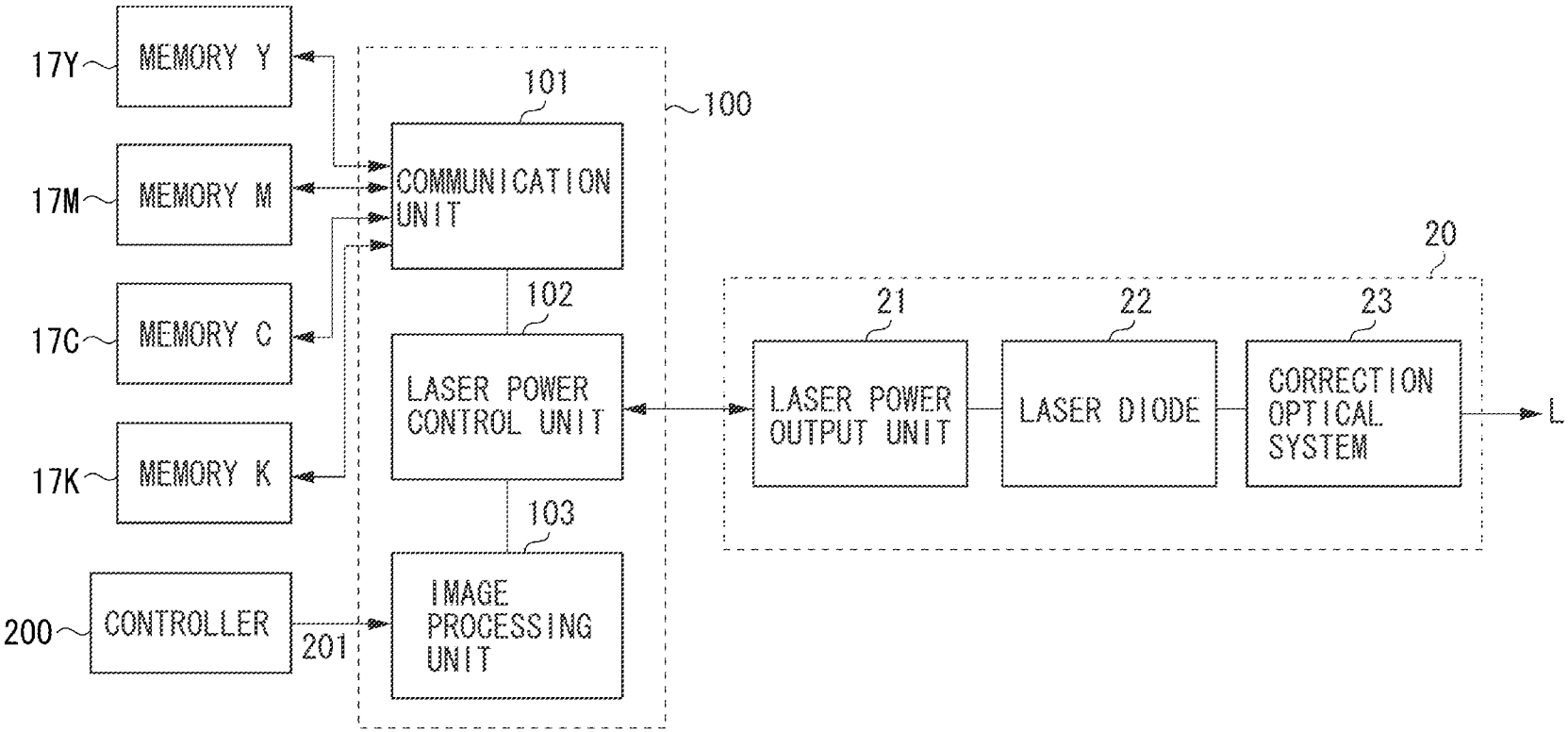
FIG. 11 is a block diagram illustrating a laser power control system.

Referring to FIG. 11, the laser exposure unit 20 according to the present exemplary embodiment will be described. FIG. 11 is a block diagram illustrating a laser power control system. The laser exposure unit 20 according to the present exemplary embodiment is configured to switch a laser output for exposing the surfaces of the photosensitive drums 11 between two levels of output values of a first laser power (E1) and a second laser power (E2). More specifically, the control unit 100 includes a laser power control unit 102 which individually controls the laser powers. An image signal transmitted from the controller 200 is a multi-valued signal (0 to 255) having eight bits=256 levels of depth direction. If the image signal is zero, the laser light L is off. If the image signal is 255, the laser light L is fully on (fully lit). If the image signal falls within the range of 1 to 254, the laser light L has an intermediate value for a while. In the present exemplary embodiment, an image processing unit 103 converts the the image signal into a serial time-series digital signal. The image processing unit 103 controls the serial time-series digital signal in 256 levels by using area gradations with a 4×4 dither matrix, and laser pulse width modulation. The laser pulse width modulation includes controlling the laser emission time of 600-dots/inch dot pulses. A communication unit 101 reads information about the thicknesses and sensitivities of the photosensitive drums 11Y to 11K, stored in the memories 17Y to 17K of the respective process cartridges 10Y to 10K. The laser power control unit 102 transmits a laser power signal selected according to the state of the photosensitive drum 11 of each process cartridge 10 and an image data signal for each process cartridge 10, to the laser exposure unit 20. A laser power output unit 21 switches laser power according to the laser power signal input from the laser power control unit 102, and makes a laser diode 22 emit laser light. The photosensitive drum 11 is irradiated with the laser light as laser scanning light L through a correction optical system 23 including a polygon mirror.

In the present exemplary embodiment, the laser power control unit 102 individually controls the first laser power (E1) and the second laser power (E2) for each process cartridge 10. The first laser power (E1) is laser power for generating a dark portion potential (non-image portion potential Vd) on a non-image area. The second laser power (E2) is laser power for generating a light portion potential (image portion potential Vl) on an image area. In the present exemplary embodiment, the image forming step includes flowing a predetermined bias current through the laser diode 22 to make the laser diode 22 emit weak laser light. Such power is set as the first laser power (E1). A current of higher current value is added for an image portion, whereby the second laser power (E2) is obtained. The laser power control unit 102 controls (adjusts) the first and second laser powers E1 and E2 by making the amount of the current flowing through the laser diode 22 variable based on a photosensitive drum surface potential control to be described below.

(1-3) Description of Latent Image Settings

Figure 3A:
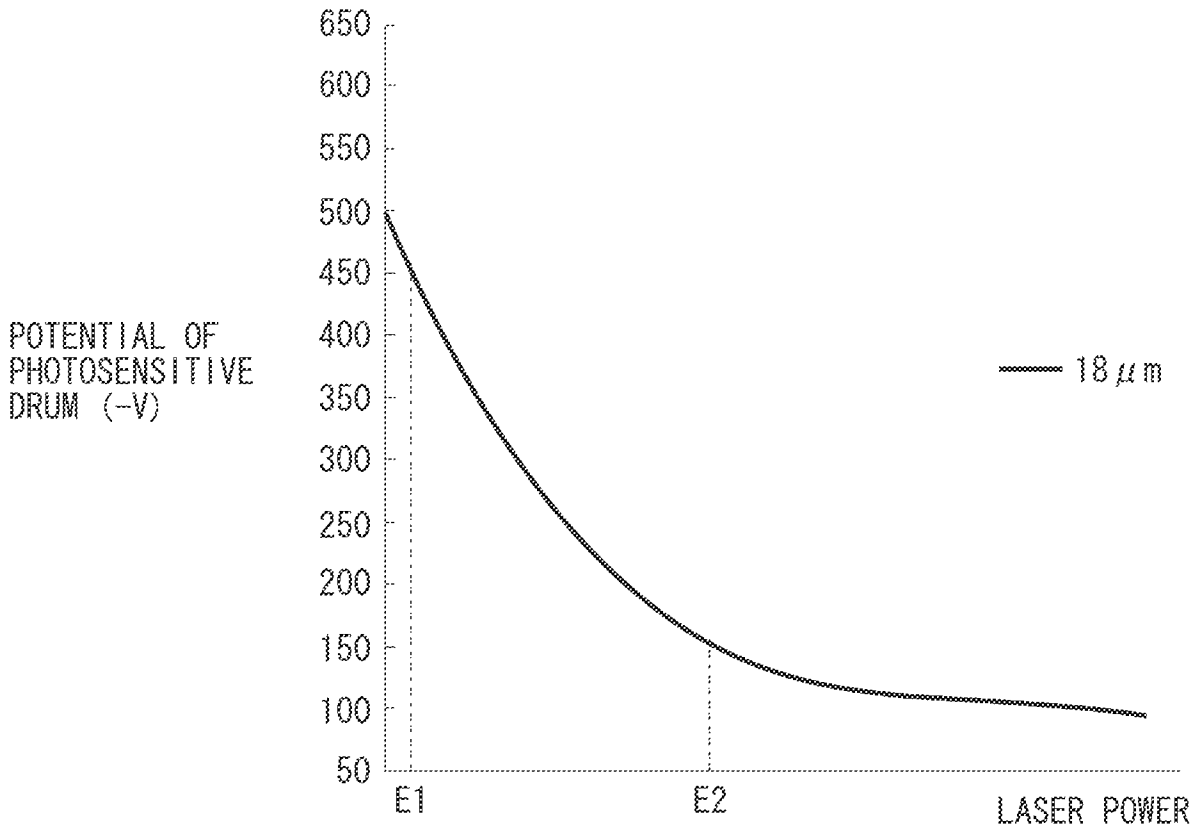
FIGS. 3A and 3B are explanatory diagrams illustrating latent image settings according to the exemplary embodiment of the present invention.
Figure 3B:
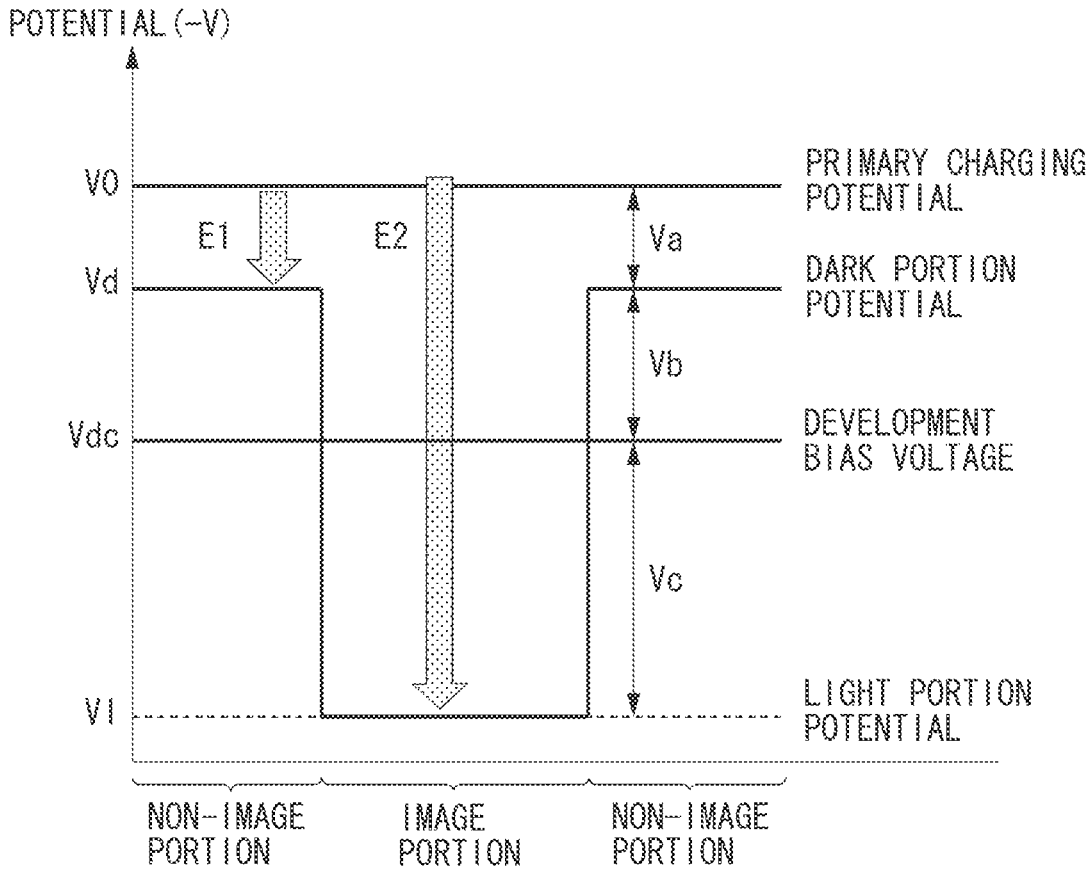

Referring to FIGS. 3A and 3B, latent image settings according to the present exemplary embodiment will be described. The photosensitive drums 11 of the present exemplary embodiment include a cylindrical base made of aluminum and an organic photoconductor (OPC; organic semiconductor) photosensitive layer covering the surface of the cylindrical base.

FIG. 3A is a graph illustrating a relationship between a surface potential and exposure laser power (hereinafter, referred to as an E-V curve) when a photosensitive drum 11 has a photosensitive layer having an initial thickness of 18 μm and a DC voltage of approximately 1040 V is applied to a charging roller 12. The horizontal axis of the graph indicates the expose laser power E $\mu J/cm^2$ which the surface of the photosensitive drum receives. The laser exposure unit 20 exposes image portions of the photosensitive drum 11 with the second laser power E2 $\mu J/cm^2$ to generate a light portion potential (Vl) of approximately 150 V. At the same time, the laser exposure unit 20 exposes non-image portions of the photosensitive drum 11 with the first laser power E1 $\mu J/cm^2$ to generate a dark portion potential (Vd) of approximately 450 V. A DC bias voltage of approximately 300 V is applied to the developing roller 13. Negatively-charged toner conveyed to the developing position therefore adheres to the portions of the light portion potential (Vl) because of a potential contrast between the light portion potential (Vl) on the photosensitive drum and the development bias voltage (Vdc), whereby an electrostatic latent image is reversely developed as a toner image.

The image forming apparatus 1 according to the present exemplary embodiment uses a reversal developing method where the charging rollers 12 charge the photosensitive drums 11 with negative charges, and negatively-charged toners are used for development. Accordingly, areas exposed with the second laser power E2 $\mu J/cm^2$ constitute image portions. Areas exposed with the first laser power E1 μJ/cm$^2$ constitute non-image portions or blank portions (background).

FIG. 3B is a diagram illustrating potential settings. A development contrast (Vc), which is a difference between the light portion potential (Vl) and the development bias voltage (Vdc), is a factor for setting image density and gradation of image portions. More specifically, when a development contrast (Vc) becomes too low, a sufficient image density and gradation cannot be obtained. The development contrast (Vc) therefore needs to be maintained at or above a predetermined value. In the present exemplary embodiment, the development contrast Vc is set to 150 V. A blank portion contrast (Vb), which is a difference between the development bias voltage (Vdc) and the dark portion potential (Vd), is a factor for determining the amount of fogging (background stain) in blank portions. More specifically, if the blank portion contrast (Vb) exceeds a predetermined value, reversely-charged toner (i.e., positively-charged toner) adheres to blank portions to produce fogging, which causes an image stain and internal contamination. On the other hand, if the blank portion contrast (Vb) falls below a predetermined value, normally-charge toner (i.e., negatively-charged toner) can be developed in blank portions to produce fogging. The blank portion contrast (Vb) therefore needs to be set within a predetermined range. In the present exemplary embodiment, the blank portion contrast Vb is set to 150 V.

A dark portion contrast (Va), which is a difference between a primary charging potential (V0) and the dark portion potential (Vd), is a factor for producing a ghost image because of transfer memory. The transfer memory is caused by the occurrence of uneven potentials on a photosensitive drum 11 after transfer because different amounts of transfer currents have flown into the photosensitive drum 11 between where there is a toner image on the photosensitive drum 11 and where there is not the toner image. Such uneven potentials after transfer appear as a ghost image over an image if the uneven potentials fail to be sufficiently evened out in a charging step. The dark portion contrast (Va) therefore needs to be maintained at or above a predetermined value. However, an excessively high contrast setting increases the amount of exposure E1 of non-image portions, which is undesirable in view of a sensitivity change of the photosensitive drum 11 and the life of the laser device. In the present exemplary embodiment, the dark contrast Va is set to be higher than or equal to 50 V.

(1-4) Description of E-V Characteristics of Photosensitive Drums

Next, change characteristics of the E-V curve of the photosensitive drums 11 will be described with reference to FIGS. 5A, 5B, 6A, 6B, and 10A.

Figure 5A:
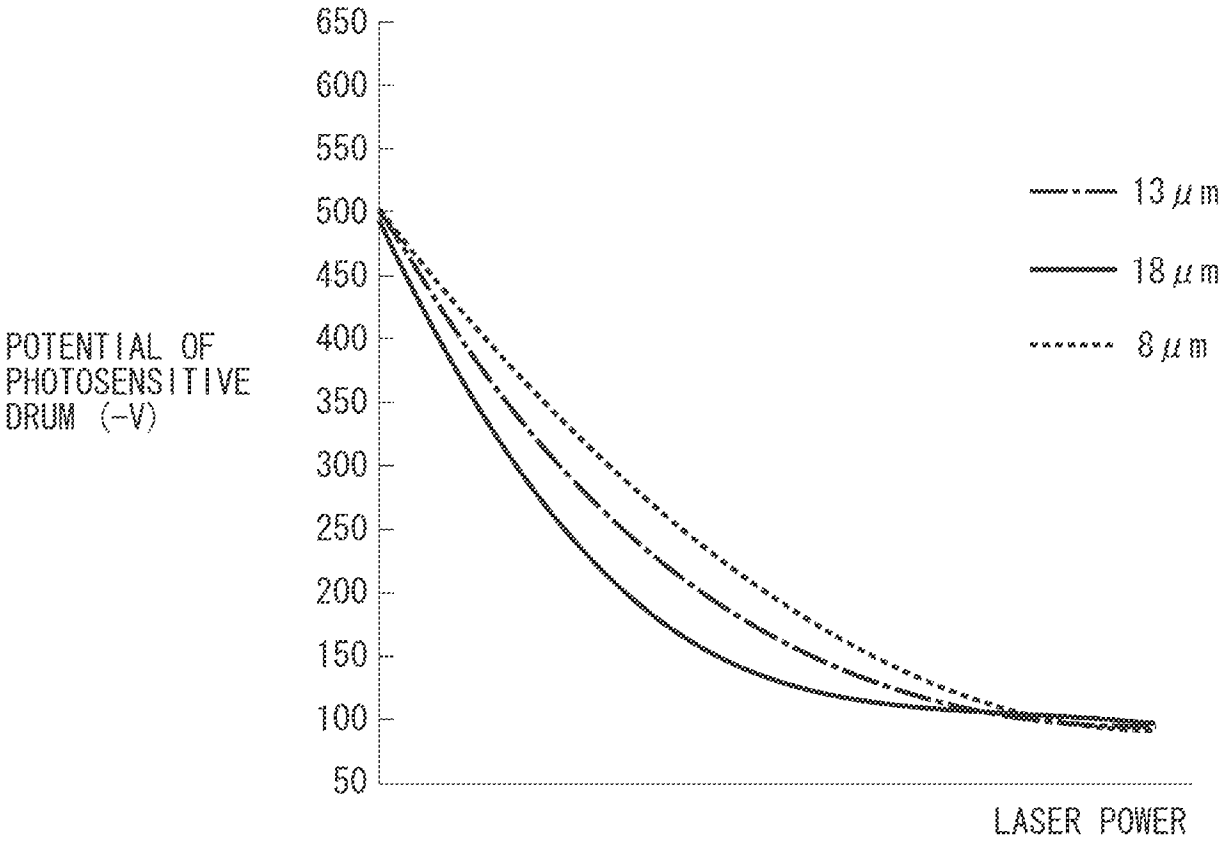
FIGS. 5A and 5B are graphs illustrating a relationship between a thickness of a photosensitive layer of a photosensitive drum and an E-V curve.

The photosensitive layers at the surfaces of the photosensitive drums 11 are repeatedly subject to a discharge during a print operation. The surfaces of the photosensitive layers are also shaved due to sliding friction caused by the cleaning blades 14 and the developing rollers 13. As a result, the photosensitive layers decrease in thickness, with a change in surface potential characteristics. FIG. 5A illustrates E-V curves when the charging bias voltages to photosensitive drums 11 of respective different thicknesses are adjusted to provide the same primary charging potential. As the thickness decreases, surface charge density increases and the gradients of the E-V curves decrease. In other words, the potentials of the photosensitive drums 11 vary depending on secular changes in the thicknesses of the photosensitive layers and the thicknesses of the photosensitive layers at the time of manufacturing (initial thicknesses).

Figure 5B:
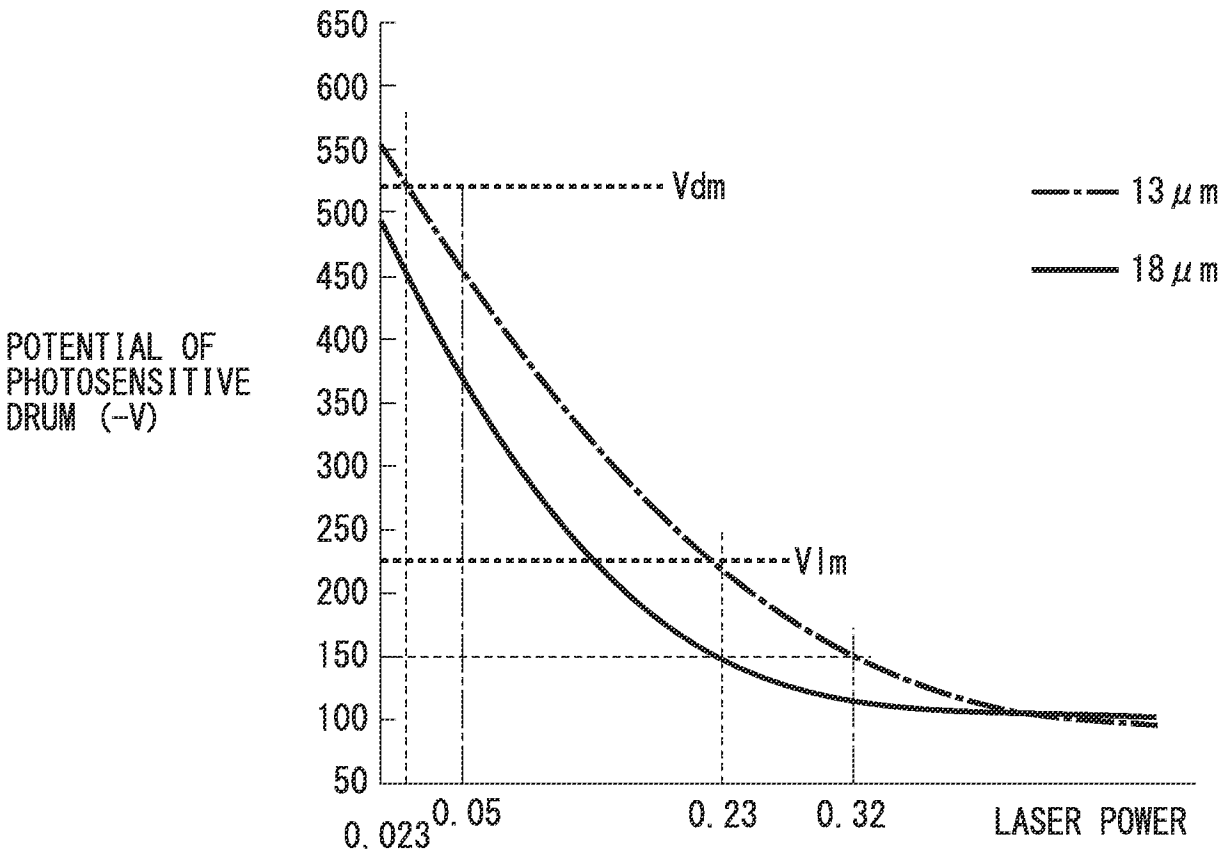

If the charging bias voltage is fixed to a predetermined value, the primary charging potential increases according to the changes of the thicknesses of the photosensitive layers. That is because a discharge start voltage between a charging roller 12 and a photosensitive drum 11 decreases along with an increasing capacitance. FIG. 5B illustrates E-V curves when photosensitive drums 11 having photosensitive layers of different thicknesses are charged with the charging bias voltage fixed to a predetermined value. Specifically, the E-V curves are those of a photosensitive drum 11 having a 18-μm-thick photosensitive layer and a photosensitive drum having a 13-μm-thick photosensitive layer when the output value of the charging bias voltage is fixed to approximately 1040 V. As the thickness of the photosensitive layer changes, the primary charging potential increases and the gradient of the E-V curve varies. If the photosensitive layer has a thickness of 18 μm, first and second laser powers E1 and E2 that provide a desired dark portion potential (Vd) and light portion potential (Vl) are E1=0.023 μJ/cm$^2$ and E2=0.23 μJ/cm$^2$, respectively. If a print test is continued with the constant charging bias voltage without changing the first and second laser powers E1 and E2 until the photosensitive layer becomes 13 μm in thickness, both the dark portion potential (Vd) and the light portion potential (Vl) are found to deviate from the target values to Vdm and Vlm, respectively.

Figure 6A:
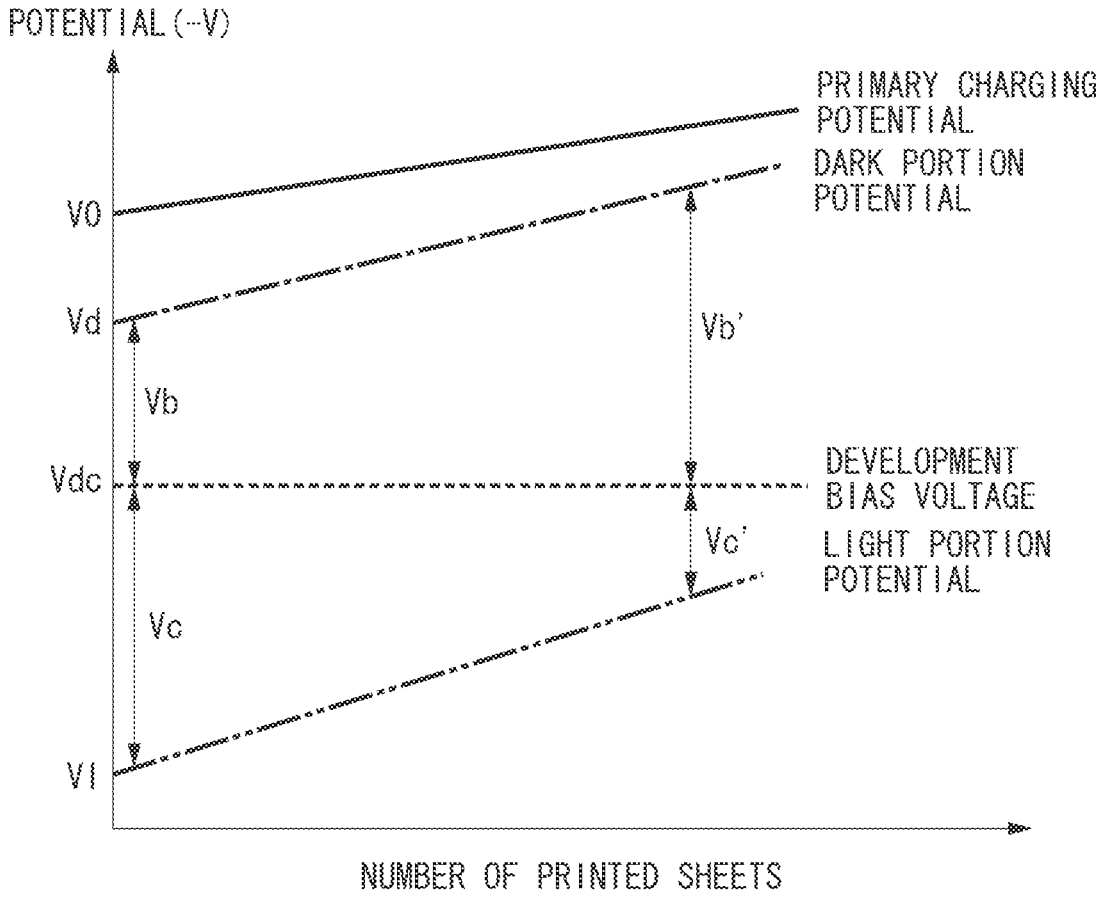
FIGS. 6A and 6B are charts illustrating a potential transition based on use information about a photosensitive drum.

FIG. 6A is a chart schematically illustrating potential transitions of Vd and Vl when the charging bias voltage is fixed and the first and second laser powers E1 and E2 are not changed according to use information about a photosensitive drum 11. The number of printed sheets is used as the amount of use of the photosensitive drum 11. As described above, the dark portion voltage (Vd) and the light portion voltage (Vl) increase as the E-V curve varies according to changes in the thickness of the photosensitive layer. As a result, the blank portion contrast (Vb') increases and the development contrast (Vc') decreases with a deterioration of image quality such as image density, fogging, line widths, and gradation.

Figure 6B:
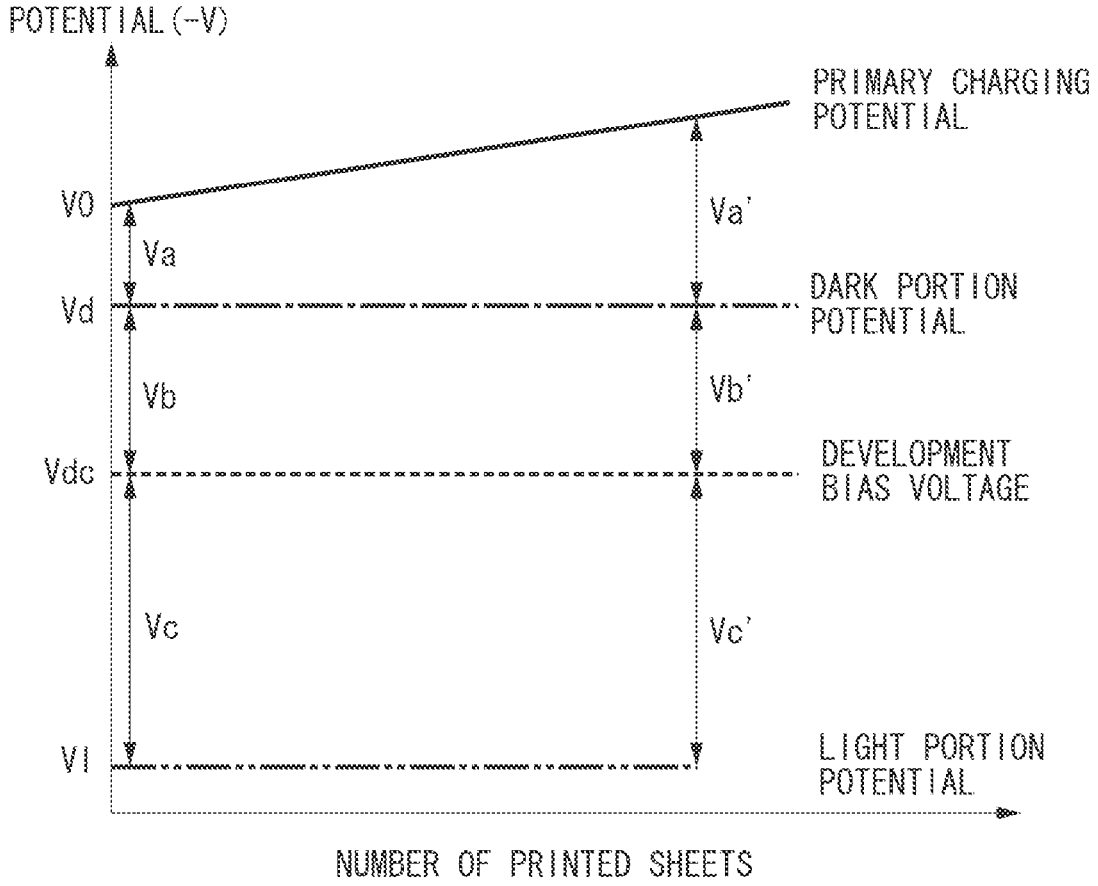

FIG. 6B is a chart schematically illustrating potential changes of Vd and Vl when the charging bias voltage is fixed and the first and second laser powers E1 and E2 are changed according to use information about a photosensitive drum 11 (changes in the thickness of the photosensitive layer). As illustrated in FIG. 5B, when the photosensitive layer becomes 13 μm in thickness, the first and second laser powers E1 and E2 are set to E1=0.05 μJ/cm$^2$ and E2=0.32 μJ/cm$^2$, respectively. Such settings can provide the desired dark portion potential Vd=450 V and the desired light portion potential Vl=150 V as with a 18-μm-thick photosensitive layer. Such control of the laser powers E1 and E2 based on thickness information about the photosensitive drum 11 can stably maintain the dark portion potential (Vd) and the light portion potential (Vl) throughout the life. Note that, in such a case, the E-V curve changes along with a change in the thickness of the photosensitive layer, and the increased primary charging potential V0 produces a dark portion contrast (Va') higher than necessary.

Figure 10A:
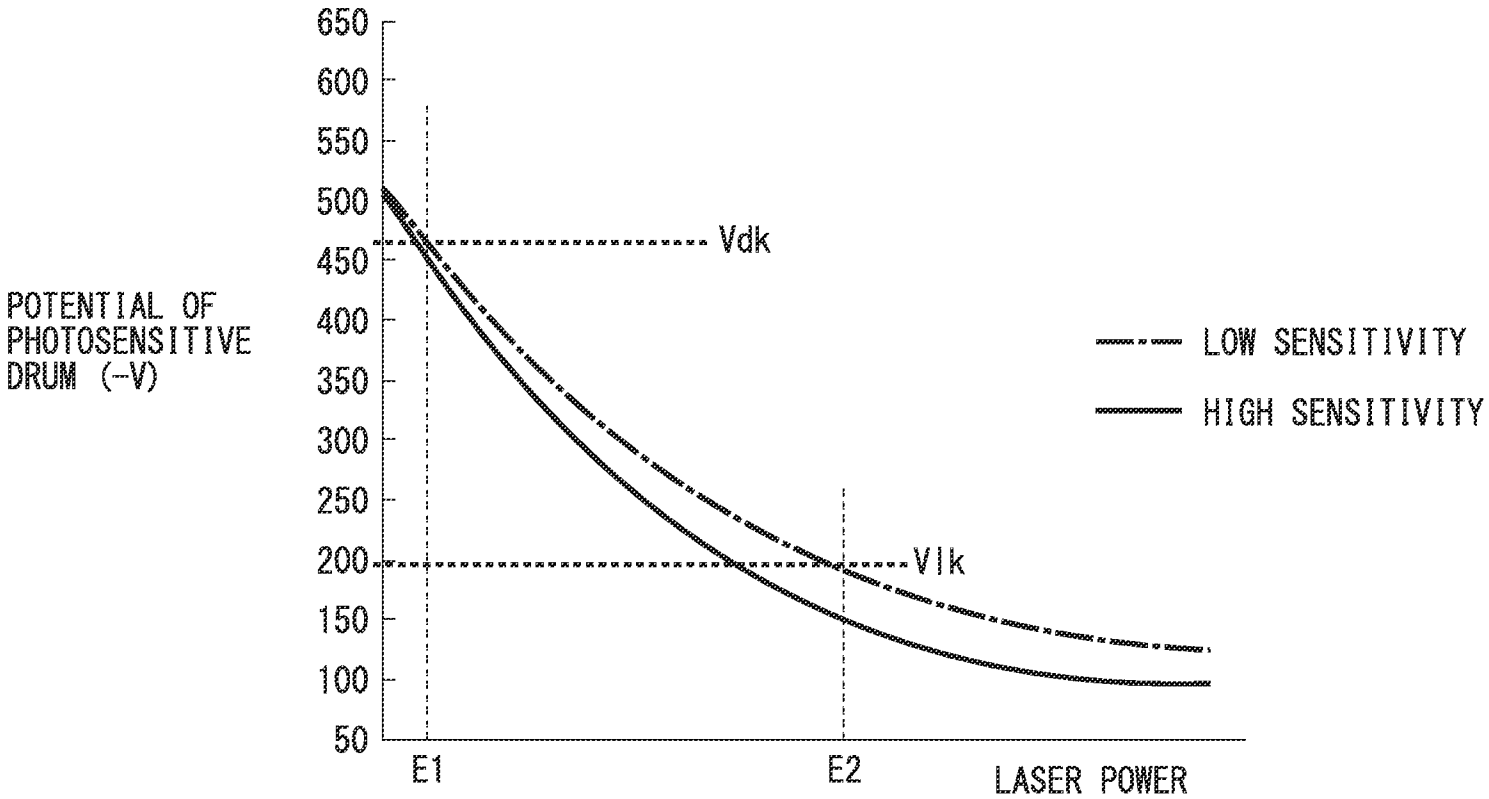
FIGS. 10A and 10B are graphs illustrating a relationship between a sensitivity of a photosensitive layer of a photosensitive drum and an E-V curve.

Another factor that changes the E-V curve of a photosensitive drum 11 is sensitivity variations of the photosensitive layer. The sensitivity variations are characteristics of each individual photosensitive drum 11, resulting from manufacturing conditions and materials. FIG. 10A illustrates E-V curves when 13-μm-thick photosensitive drums 11 having different sensitivities are charged to a predetermined primary charging potential. As illustrated in FIG. 10A, the gradient of the E-V curve depends on the sensitivity of the photosensitive layer. If the first and second laser powers E1 and E2 are set for a photosensitive drum 11 of higher sensitivity, a photosensitive drum 11 of lower sensitivity fails to provide the target dark portion voltage (Vd) and light portion voltage (Vl) but Vdk and Vlk, respectively. The sensitivity of the photosensitive layer does not necessarily have the same degree of influence on the first and second laser powers E1 and E2. Information about the sensitivity characteristics of the photosensitive layer resulting from a manufacturing step and material characteristics which are irrelevant to thickness, is stored into the memory 17 at the time of manufacturing as information k1 and k2 about the sensitivity of the photosensitive layer. Specifically, the information k1 indicates the degree of influence of the sensitivity of the photosensitive layer on the laser power E1. The information k2 indicates the degree of influence of the sensitivity of the photosensitive layer on the laser power E2.

Figure 4:
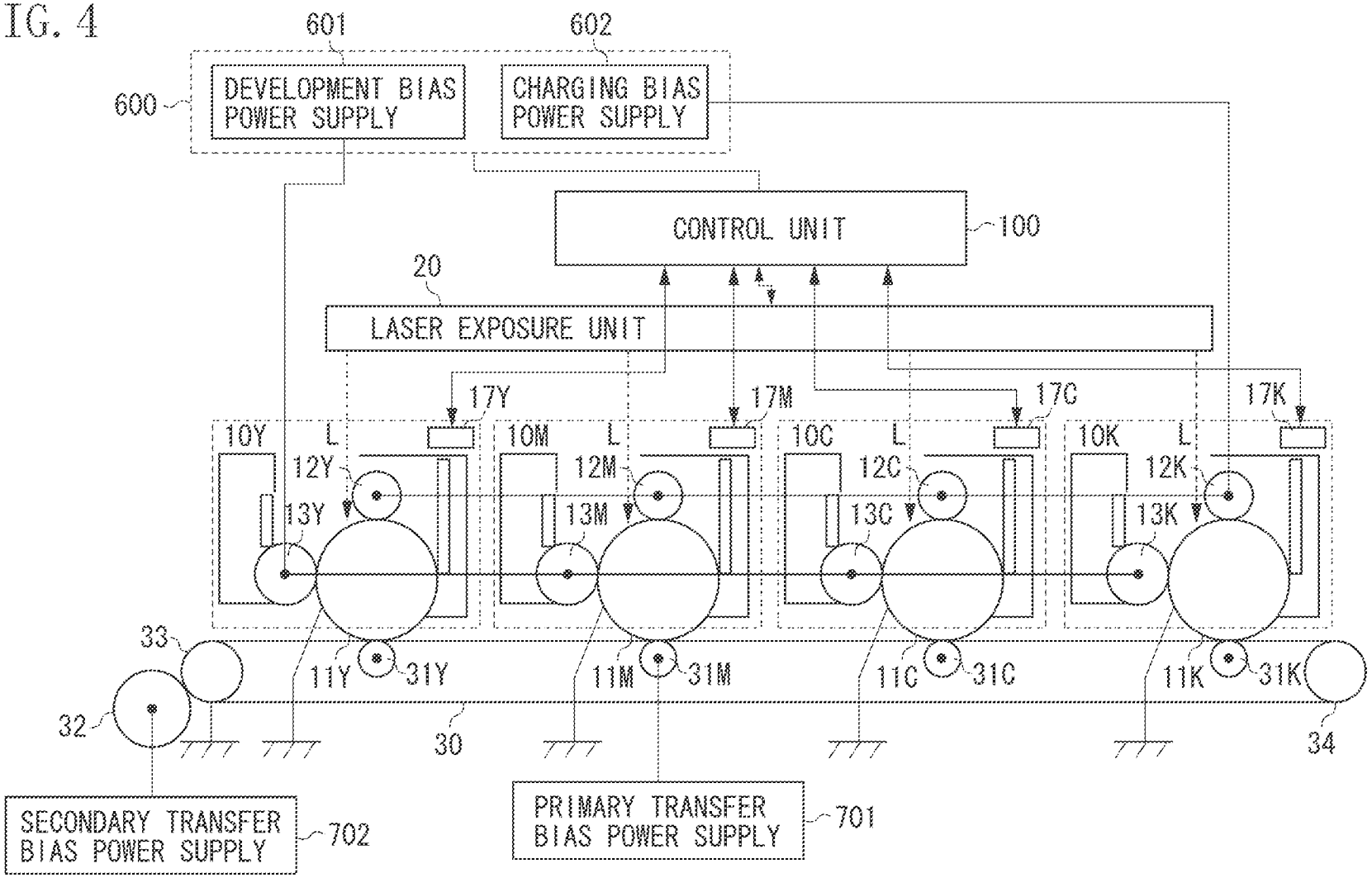
FIG. 4 is a diagram illustrating power supply wiring according to the exemplary embodiment of the present invention.
Figure 8:
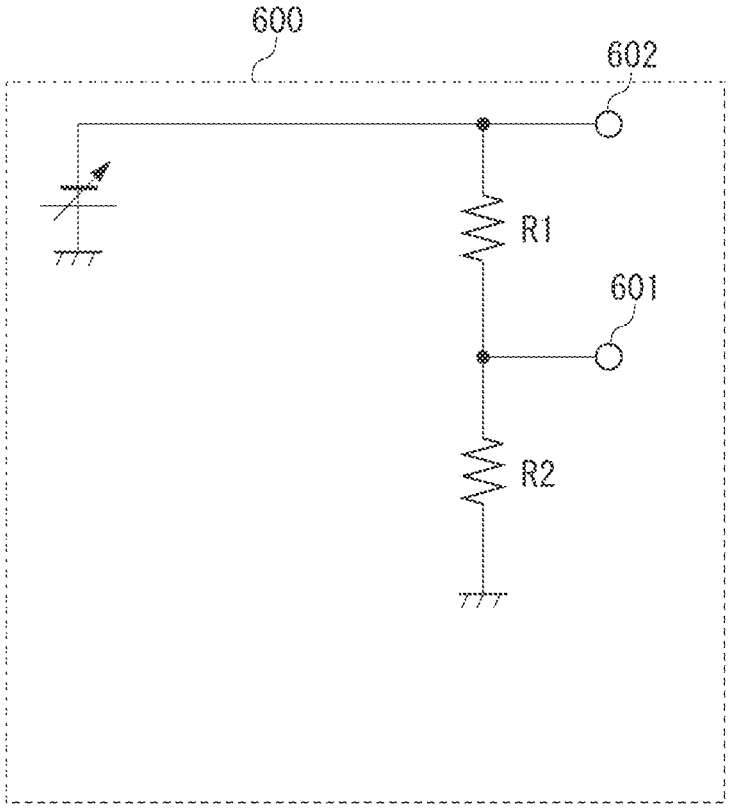
FIG. 8 is a schematic diagram illustrating a power supply circuit that outputs a charging bias voltage and a development bias voltage.

(1-5) Description of General Configuration about High-Voltage Power Supply Circuit FIG. 4 is a wiring diagram illustrating connections between a power supply unit 600 (charging bias power supply 602 and development bias power supply 601) and the process cartridges 10Y to 10K according to the present exemplary embodiment. As illustrated in FIG. 4, the common charging bias supply 602 is connected to the charging rollers 12Y to 12K of the process cartridges 10Y to 10K. In other words, the same charging bias voltage is applied to the charging rollers 12Y to 12K. Similarly, the common development bias power supply 601 is connected to the developing rollers 13Y to 13K of the process cartridges 10Y to 10K. The development bias voltage of the same value is applied to the developing rollers 13Y to 13K. In the present exemplary embodiment, as illustrated in FIG. 8, the charging bias power supply 602 and the development bias power supply 601 are configured to share circuitry as a voltage-dividing circuit. In other words, the charging bias power supply 602 and the development bias power supply 601 are configured to fix the difference between the DC voltage value of the charging bias voltage and that of the development bias voltage. FIG. 8 is a schematic diagram illustrating a power supply circuit for outputting the charging bias voltage and the development bias voltage according to the present exemplary embodiment. In such a manner, the image forming apparatus 1 according to the present exemplary embodiment includes the common power supplies for the charging rollers 12Y to 12K and the developing rollers 13Y to 13K of the process cartridges 10Y to 10K as much as possible. A number of power supplies is configured to be minimum so that miniaturization and cost saving of the image forming apparatus 1 can be realized.

In the present exemplary embodiment, the charging bias power supply 602 and the development bias power supply 601 are configured as a resistance voltage-dividing circuit. However, a configuration using Zener diodes to fix the difference between the DC voltage values is also applicable to the present invention. An image forming apparatus that includes the common DC bias voltages for the primary transfer bias supply 701 which are applied to the respective primary transfer rollers 31 is also applicable.

(1-6) Description of Charging bias Voltage Setting

As described above, in the present exemplary embodiment, a common charging bias voltage (Vp) is set so that the process cartridges 10Y to 10K generate a dark portion potential of Vd=450 V and a dark portion contrast of Va=50 V or higher with a minimum necessary amount of exposure of a non-image portion (E1). Specifically, the control unit 100 reads information mi (μm) about an initial thickness and information mj (μm) about the amount of change in thickness from each of the memories 17Y to 17K of the process cartridges 10Y to 10K. The control unit 100 serving as the control unit and the acquisition unit according to an exemplary embodiment of the present invention calculates (acquires) thicknesses (mi−mj) μm from the information. With respect to a maximum thickness (mi−mj)max μm among the thicknesses of the photosensitive drums 11, the control unit 100 then calculates a charging bias voltage (Vp) to generate a primary charging potential V0=500 (V) based on the following equation (Eq. 1):

$$Vp=\alpha\times(mi-mj)\max+\beta, \text{ and} \quad \text{(Eq. 1)}$$

$$mj=\epsilon\times t, \quad \text{(Eq. 2)}$$

where α, β, and ϵ are coefficients.

(1-7) Description of Laser Power Control

Figure 7A:
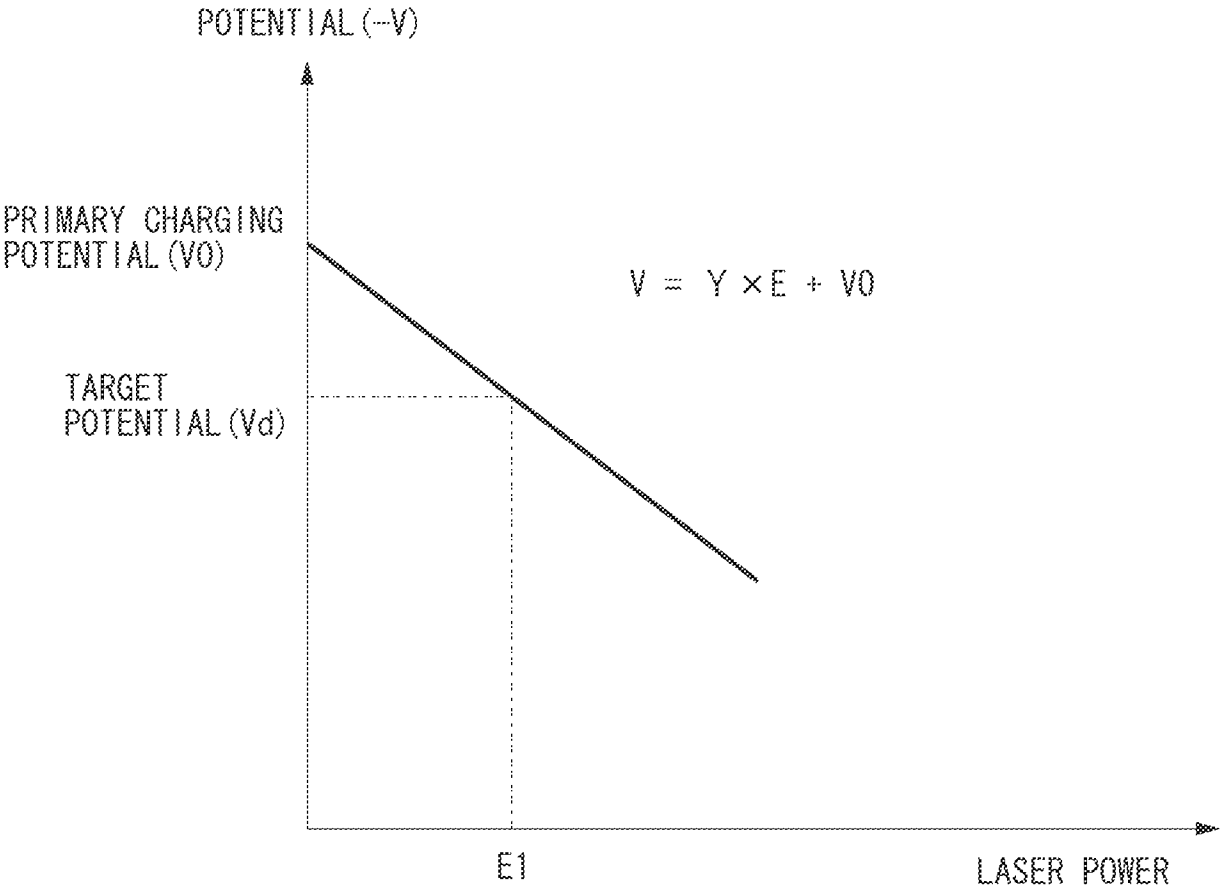
FIGS. 7A and 7B are charts illustrating a method for calculating laser powers E1 and E2 according to the exemplary embodiment of the present invention.
Figure 7B:
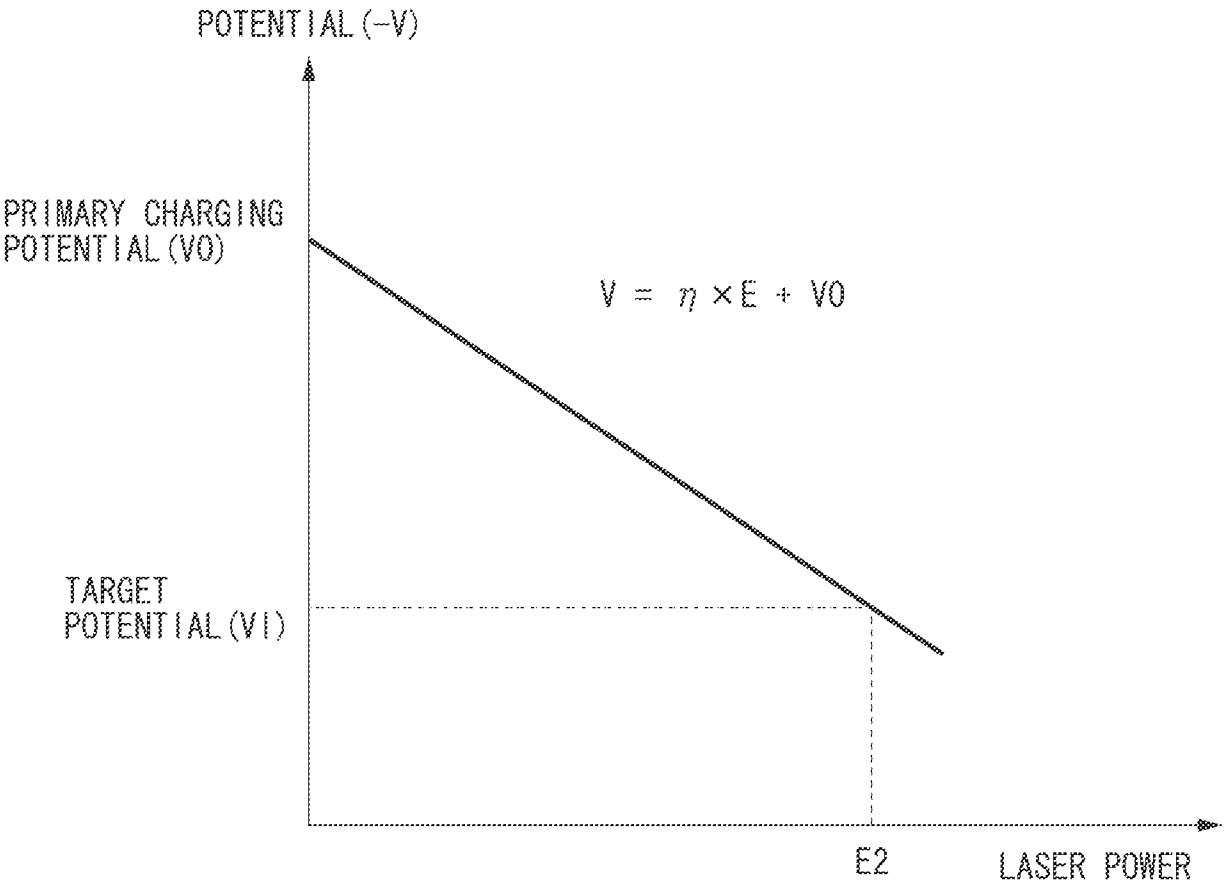

Next, a method for setting the laser power of the amount of exposure of a non-image portion (E1) and the amount of exposure of an image portion (E2) according to the present exemplary embodiment will be described below with reference to FIGS. 7A and 7B. FIG. 7A is a chart illustrating a method for calculating the laser power E1. FIG. 7B is a chart illustrating a method for calculating the laser power E2. In the present exemplary embodiment, E-V curves are precisely predicted from the thicknesses (initial thicknesses) of the photosensitive drums 11 at the time of manufacturing and use history information about the photosensitive drums 11. The first and second laser powers E1 and E2 are then controlled to generate the desired dark light potential (Vd) and light portion potential (Vl). Specifically, actual use areas of the E-V curves of the photosensitive drums 11 are approximated by linear functions having different gradients as illustrated in FIGS. 7A and 7B. Then, the first and second laser powers E1 and E2 necessary to provide the target dark portion voltage of Vd=450 V and light portion potential Vl=150 V are calculated, respectively. The control unit 100 reads the information mi (μm) about the initial thicknesses, the information mj (μm) about the amounts of change in thickness, and the information k1 and k2 about the sensitivity of the photosensitive layers from the memories 17Y to 17K of the process cartridges 10Y to 10K. The control unit 100 calculates the charging bias voltage (Vp) common to all the process cartridges 10Y to 10K by the foregoing method. Next, the control unit 100 calculates the first and second laser powers E1 and E2 for each of the process cartridges 10Y to 10K based on the following equations (Eq. 3) to (Eq. 7):

$$E1=k1\times(Vd-V0)/\gamma, \quad \text{(Eq. 3)}$$

$$E2=k2\times(Vl-V0)/\eta, \quad \text{(Eq. 4)}$$

$$V0=Vp-\alpha\times(mi-mj)+5, \quad \text{(Eq. 5)}$$

$$\gamma=\omega\times(mi-mj)+\tau, \text{ and} \quad \text{(Eq. 6)}$$

$$\eta=\mu\times\gamma, \quad \text{(Eq. 7)}$$

where α, δ, ω, τ, and μ are coefficients.

The initial thicknesses mi (μm) and the information k1 and k2 about the sensitivity of the photosensitive layers are information written to the memories 17 at the time of manufacturing. The amounts of change in thickness mj (μm) are information that is calculated from the number of printed sheets and written to the memories 17 when necessary. The first and second laser powers E1 and E2 both increase in proportion to the change in thickness (mj), whereas the rate of increase (the rate of increase with respect to the laser power when mj=0) varies depending on the sensitivity characteristics of the photosensitive layer (see FIG. 5A). In the present exemplary embodiment, the control unit 100 thus individually calculates the output values of E1 and E2 based on the thicknesses of the respective photosensitive layers and the sensitivity characteristics (k1 and k2) of the photosensitive layers. While the equations (Eq. 1) to (Eq. 7) of the present exemplary embodiment are linear functions, appropriate equations may be determined according to the characteristics of the photosensitive drums 11 and the image forming apparatus 1. Polynomial equations or equations including a combination of a plurality of curves may be used. In the present exemplary embodiment, the relationship between the thickness of a photosensitive drum 11, the charging bias voltage, and the primary charging potential was experimentally determined and associated in advance. The equations are not limited to the above. To calculate the amounts of change in thickness of the photosensitive layers, any one or a combination of the application time of the charging bias voltage, the rotation time of the photosensitive drums 11, and the total numbers of rotations of the photosensitive drums 11 may be used as an index for indicating the use frequency of the photosensitive drums 11 aside from the number of printed sheets (the number of times of image formation). The coefficients $\alpha$, $\beta$, $\epsilon$, $\delta$, $\omega$, $\tau$, and $\mu$ may be arbitrarily optimized according to the characteristics of the photosensitive drums 11 and the image forming apparatus 1. If the image forming apparatus 1 includes a sensor for detecting an ambient condition in which the image forming apparatus 1 is used, like temperature and humidity, the image forming apparatus 1 may be configured to correct the coefficients according to the detected ambient condition. Such correction enables more detailed control. In the present exemplary embodiment, the information about the sensitivity of the photosensitive drums 11 was set so that k1=1 and k2=1. The coefficients $\alpha=10$, $\beta=860$, $\delta=-360$, $\omega=-80$, $\tau=-700$, $\mu=0.7$, and $\epsilon=5\times10^{-4}$ were employed.

(1-8) Flowchart Illustrating Photosensitive Drum Surface Potential Control

Figure 1:
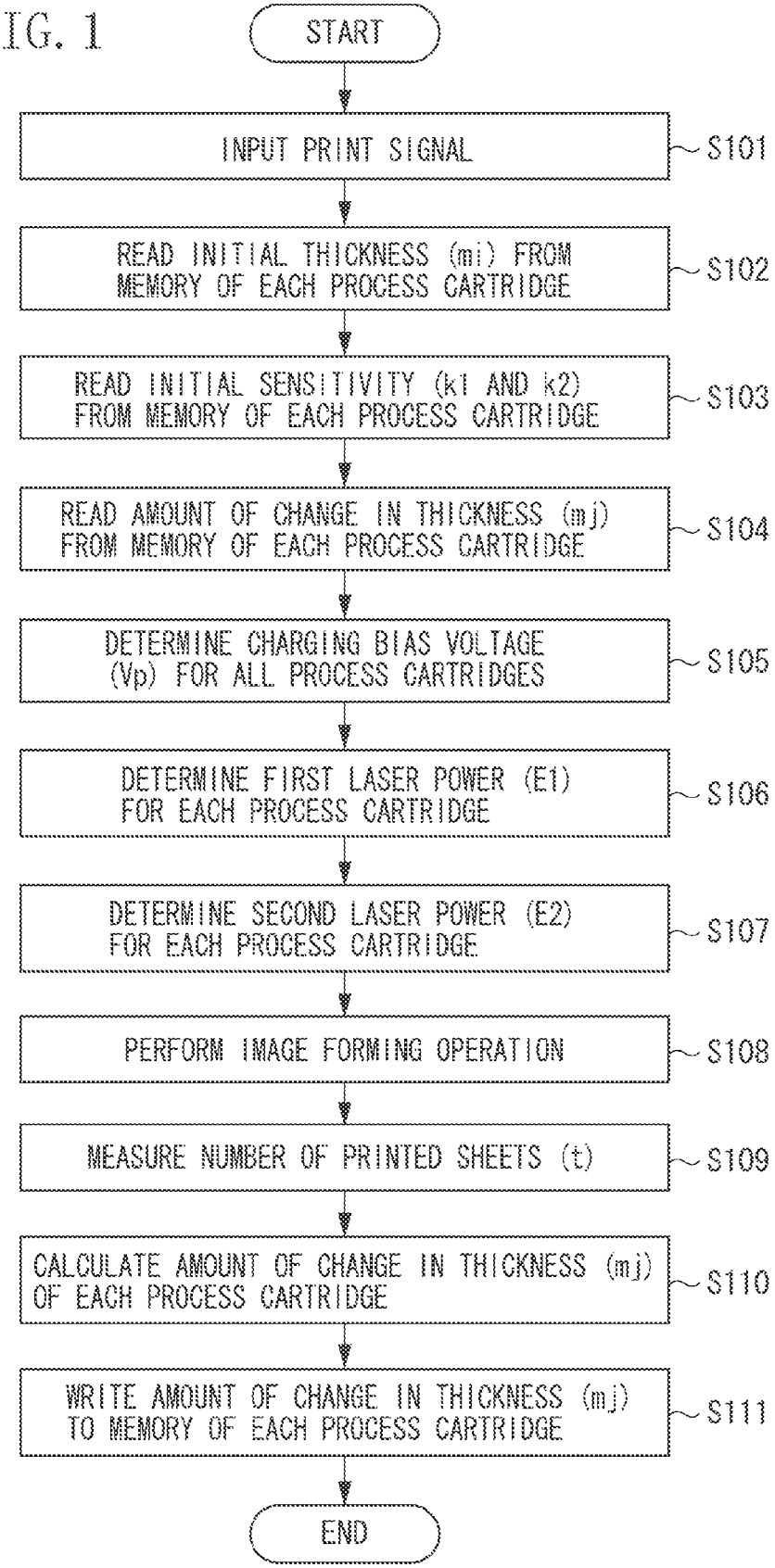
FIG. 1 is a flowchart illustrating a control according to a first exemplary embodiment of the present invention.

Next, a laser power control method according to the present exemplary embodiment will be described with reference to a flowchart of FIG. 1. In step S101, the controller 200 inputs a print signal. The communication unit 101 in the image forming apparatus 1 communicates with the memories 17Y to 17K mounted on the process cartridges 10Y to 10K. In steps S102 to S104, the communication unit 101 reads the initial thickness mi, initial sensitivity (information about the sensitivity of the photosensitive layer) k1 and k2, and the amount of change in thickness mj stored in each memory 17.

In step S105, the control unit 100 determines the charging bias voltage Vp for all the process cartridges 10Y to 10K based on the equation (Eq. 1). In step S106, the control unit 100 determines the first laser power E1 for each process cartridge 10 based on the equations (Eq. 3) to (Eq. 7). In step S107, the control unit 100 similarly determines the second laser power E2. In step S108, the control unit 100 performs an image forming operation. In step S109, the control unit 100 measures the number of printed sheets t. In step S110, the control unit 100 calculates the amount of change in thickness mj from the measurement result based on the equation (Eq. 2). In step S111, the control unit 100 writes (overwrites) the calculation result to the memory 17 of each process cartridge 10 via the communication unit 101.

As an example of the foregoing control, printing was performed by using a color image forming apparatus including different types of process cartridges having a photosensitive drum X with an initial thickness of 18 μm and a photosensitive drum Y with an initial thickness of 13 μm. FIG. 5B illustrate E-V curves of the photosensitive drums X and Y. The control unit 100 read thickness information from the memories 17, and set a charging bias voltage Vp=1040 V to generate a primary charging potential V0=500 V on the photosensitive drum X having the maximum thickness. The control unit 100 then set the first and second laser powers E1 and E2 for the photosensitive drum X to E1=0.023 μJ/cm$^2$ and E2=0.23 μJ/cm$^2$, respectively, to generate the dark portion potential Vd=450 V and the light portion potential Vl=150 V. Since the common charging bias voltage Vp=1040 V was also applied to the photosensitive drum Y, a primary charging potential V0=550 V was generated on the photosensitive drum Y. For the photosensitive drum Y, the control unit 100 set the laser powers E1=0.05 μJ/cm$^2$ and E2=0.32 μJ/cm$^2$ to obtain the dark portion potential Vd=450 V and the light portion potential Vl=150 V.

Figure 12A:
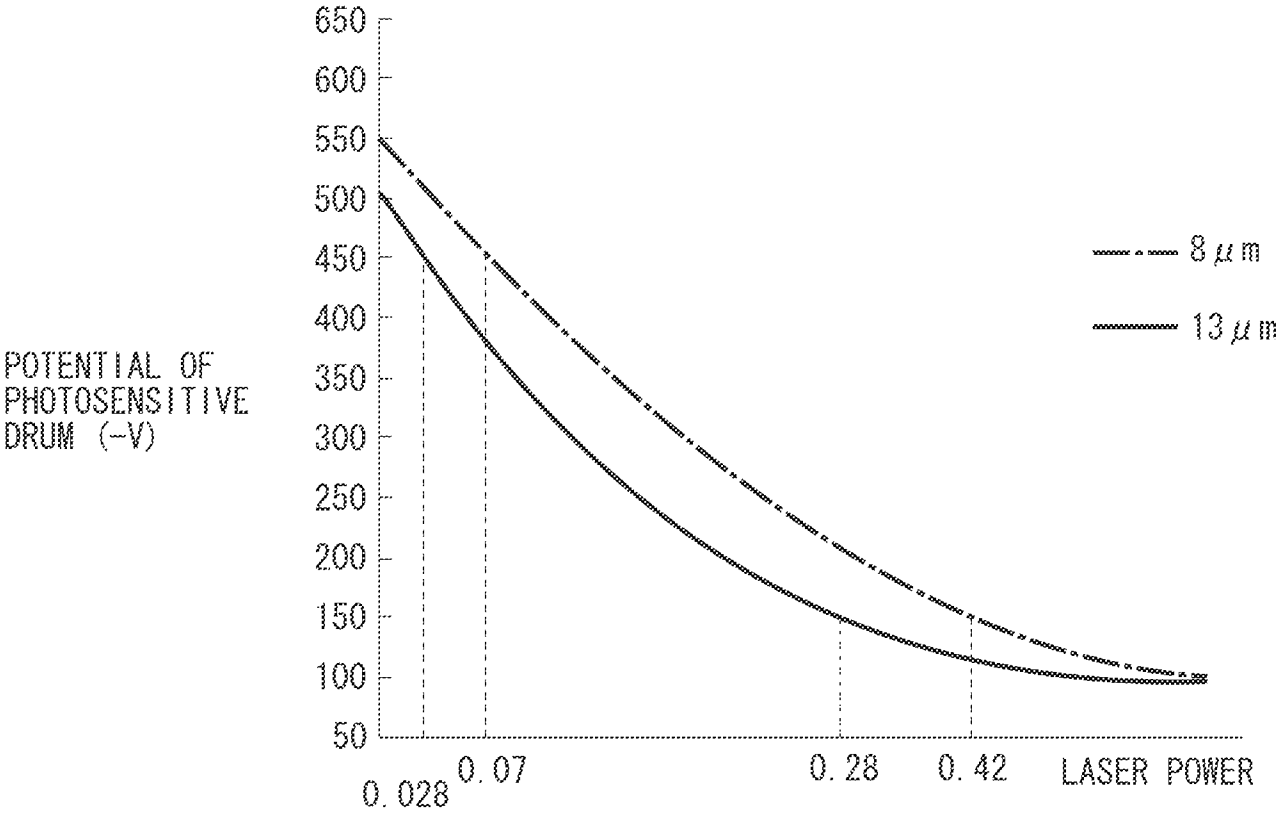
FIGS. 12A and 12B are graphs illustrating a relationship between a thickness of a photosensitive layer of a photosensitive drum and an E-V curve.
Figure 12B:
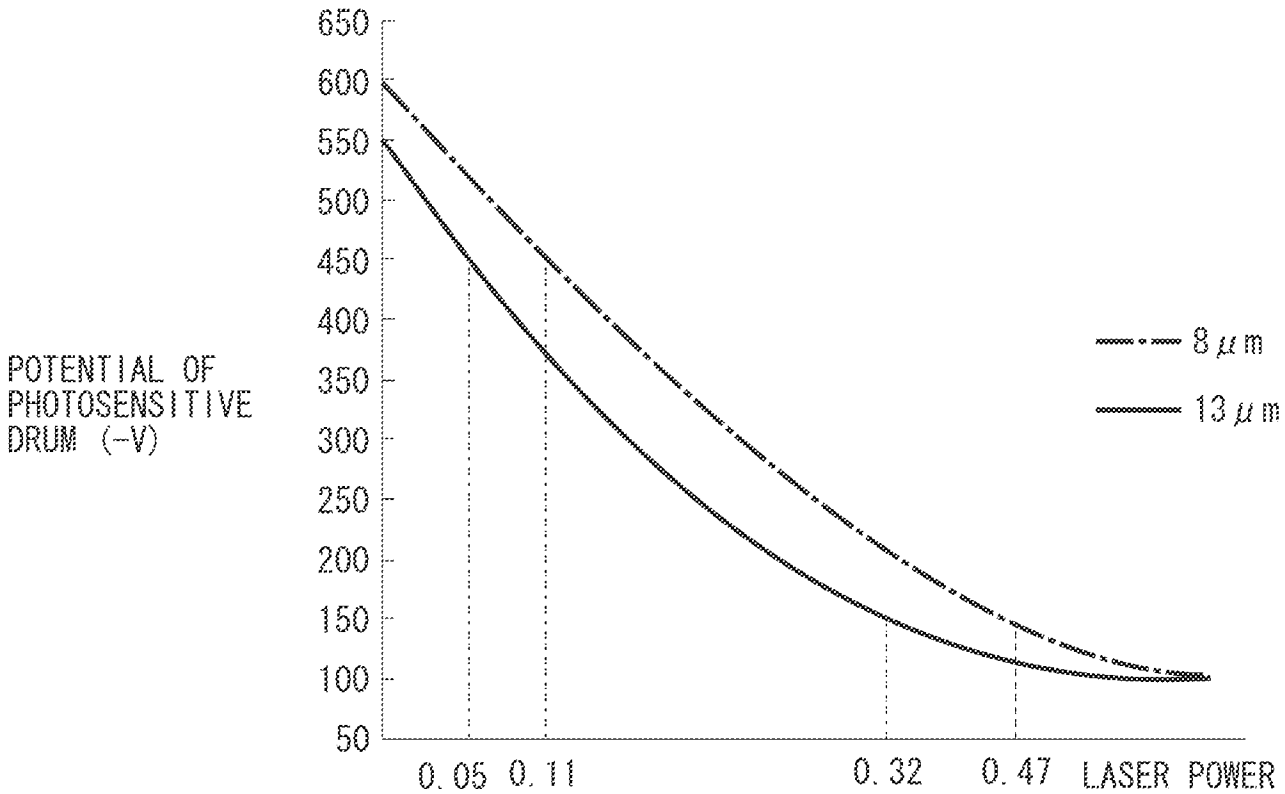

Subsequently, 10000 sheets of print test was performed by using the foregoing image forming apparatus. The amounts of change in thickness of the photosensitive drums X and Y were both 5 μm. The resulting thicknesses of the photosensitive layers were 13 μm and 8 μm, respectively. FIG. 12A illustrate the E-V curves of the photosensitive drums X and Y at that time. The control unit 100 read the thickness information from the memories 17, recognized the thickness of the photosensitive drum X of 13 μm to be the maximum thickness, and set a charging bias voltage Vp=990 V to generate a primary charging potential V0=500 V. The control unit 100 then set the first and second laser powers E1 and E2 for the photosensitive drum X to E1=0.028 μJ/cm$^2$ and E2=0.28 μJ/cm$^2$, respectively, to generate the dark portion potential Vd=450 V and the light portion potential Vl=150 V. Since the common charging bias voltage Vp=990 V was also applied to the photosensitive drum Y, a primary charting potential V0=550 V was generated on the photosensitive drum Y. The control unit 100 then set the laser powers E1=0.07 μJ/cm$^2$ and E2=0.42 μJ/cm$^2$ to obtain the dark portion potential Vd=450 V and the light portion potential Vl=150 V. For comparison, a case where the charging bias voltage control of the present exemplary embodiment is not performed will be described with reference to E-V curves illustrated in FIG. 12B. At this time, the charging bias voltage is fixed to 1040 V, the same as in the initial state. The first and second laser powers E1 and E2 for the photosensitive drum X after the change in thickness are E1=0.05 μJ/cm$^2$ and E2=0.32 μJ/cm$^2$. The first and second laser powers E1 and E2 for the photosensitive drum Y after the change in thickness are E1=0.11 μJ/cm$^2$ and E2=0.47 μJ/cm$^2$. The comparison of the results shows that the control according to the present exemplary embodiment can minimize the amounts of exposure of the photosensitive drums 11.

In the present exemplary embodiment, the first and second laser powers E1 and E2 are defined as the amounts of exposure which the surface of a photosensitive drum 11 driven to rotate at the surface speed of 120 (mm/sec) receives. The control unit 100 controls the output value of the laser to obtain the amounts of each exposure.

As has been described above, the present exemplary embodiment is characterized in that the charging bias voltage and the amount of background exposure are controlled to generate the non-image portion potential (Vd) with a minimum necessary amount of background exposure. According to the present exemplary embodiment, a desired potential contrast can be obtained with the minimum necessary amount of exposure. This can suppress sensitivity changes of the photosensitive drums 11 over a long period of use as much as possible, and stable potential settings can be obtained. Consequently, favorable images can be stably formed over a long period of time. Since the power supplies of the charging bias voltage and the development bias voltage are shared to minimize the number of power supplies, the image processing apparatus 1 can be reduced in size and cost.

An image forming apparatus, photosensitive drums, latent image settings, and the configuration of high-voltage power supplies according to a second exemplary embodiment of the present invention are the same as those of the first exemplary embodiment. The present exemplary embodiment is characterized in that exposure histories (amounts of exposure) of the photosensitive drums are taken into account to further improve the prediction accuracy of E-V curves when controlling the laser powers E1 and E2.

(2-1) Description of E-V Characteristics of Photosensitive Drums

Figure 10B:
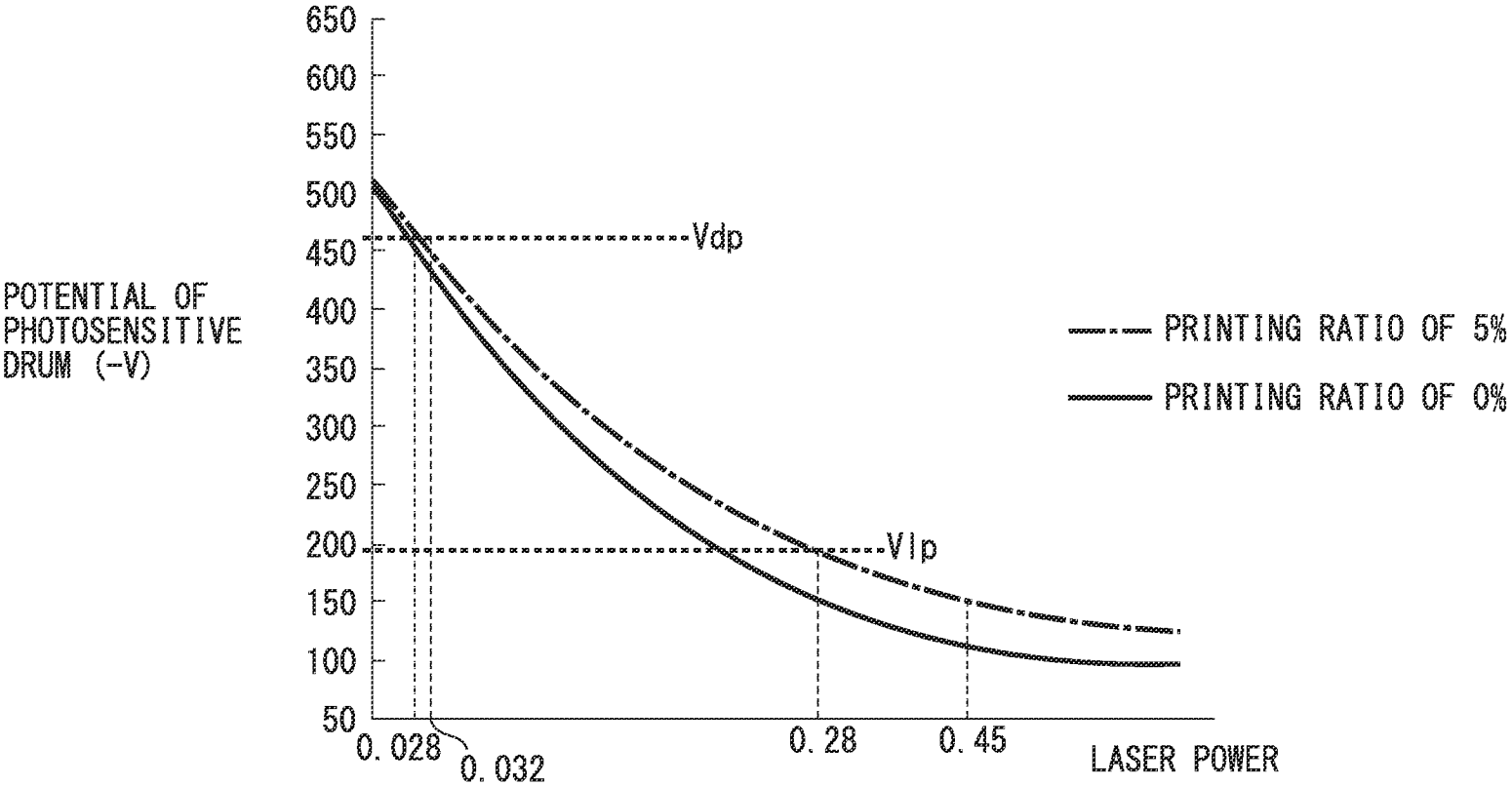

The factors that change potentials along with the use of a photosensitive drum 11 include a change (drop) in sensitivity due to laser exposure, aside from a change in the thickness of the photosensitive layer. When a photosensitive drum 11 is used, a slight change (drop) in sensitivity occurs even if the amount of exposure of non-image portions is suppressed and controlled to the minimum as in the present exemplary embodiment. The reason is that residual charges are accumulated in the photosensitive layer by repetitive exposure of image portions with relatively high exposure power (E2). The degree of change in sensitivity therefore varies depending on the area of the laser exposure, i.e., the number of pieces of image data. The higher the cumulative exposure energy, the greater the amount of residual charges. As an example, FIG. 10B illustrates the E-V curves of a 13-.mu.m-thick photosensitive drum after an image of A4 size is printed on 10000 sheets at a printing ratio of 0% and 5%. It is shown that the E-V curve varies depending on the history (so-called exposure history) of print image data. If the laser powers E1 and E2 are set for a photosensitive drum having no exposure history, a photosensitive drum having some exposure history fails to provide the target dark potion potential (Vd) and light portion potential (Vl) but Vdp and Vlp, respectively.

(2-2) Description of Photosensitive Drum Surface Potential Control According to Present Exemplary Embodiment In the present exemplary embodiment, the control unit 100 detects an exposure history ρ of the photosensitive drum 11 of each process cartridge 10. Specifically, the control unit 100 measures the number of pixels from print image data and calculates a cumulative pixel value P to determine the exposure history ρ. For example, if an image of A4 size is printed on 10 sheets at a printing ratio of 5%, the control unit 100 measures a cumulative pixel value P=50. The cumulative pixel value P is information to be written to the memories 17 each time printing is performed.

Next, the control unit 100 reads the information mi (μm) about the initial thicknesses, the information mj μm about the amounts of change in thickness, the information k1 and k2 about the sensitivity of the photosensitive layers, and the cumulative pixel values P from the memories 17Y to 17K. The control unit 100 then calculates the first and second laser powers E1 and E2 μJ/cm$^2$ necessary to obtain the dark portion potential Vd=450 (V) and the light portion potential Vl=150 (V) by using the equations (Eq. 5) to (Eq. 10). The charging bias voltage Vp is calculated by the equation (Eq. 1) described in the first exemplary embodiment.

$$E1=\lambda\times\rho\times k1\times(Vd-V0)/\gamma, \quad \text{(Eq. 8)}$$

$$E2=\rho\times k2\times(Vl-V0)/\eta, \text{ and} \quad \text{(Eq. 9)}$$

$$\rho=\zeta\times P, \quad \text{(Eq. 10)}$$

where λ and ζ are coefficients.

In the present exemplary embodiment, coefficients λ=0.7 and $\zeta=3.2\times10^{-5}$ were used. As in the first exemplary embodiment, the information k1 and k2 about the sensitivity of the photosensitive drums 11 was k1=1 and k2=1. Coefficients α=10, β=860, δ=−360, ω=−80, τ=−700, μ=0.7, and $\epsilon=5\times10^{-4}$ were used. The equations and coefficients are appropriately determined according to the characteristics of the photosensitive drums 11 and the image forming apparatus 1, and not limited to the foregoing figures.

(2-3) Flowchart Illustrating Photosensitive Drum Surface Potential Control

Figure 9:
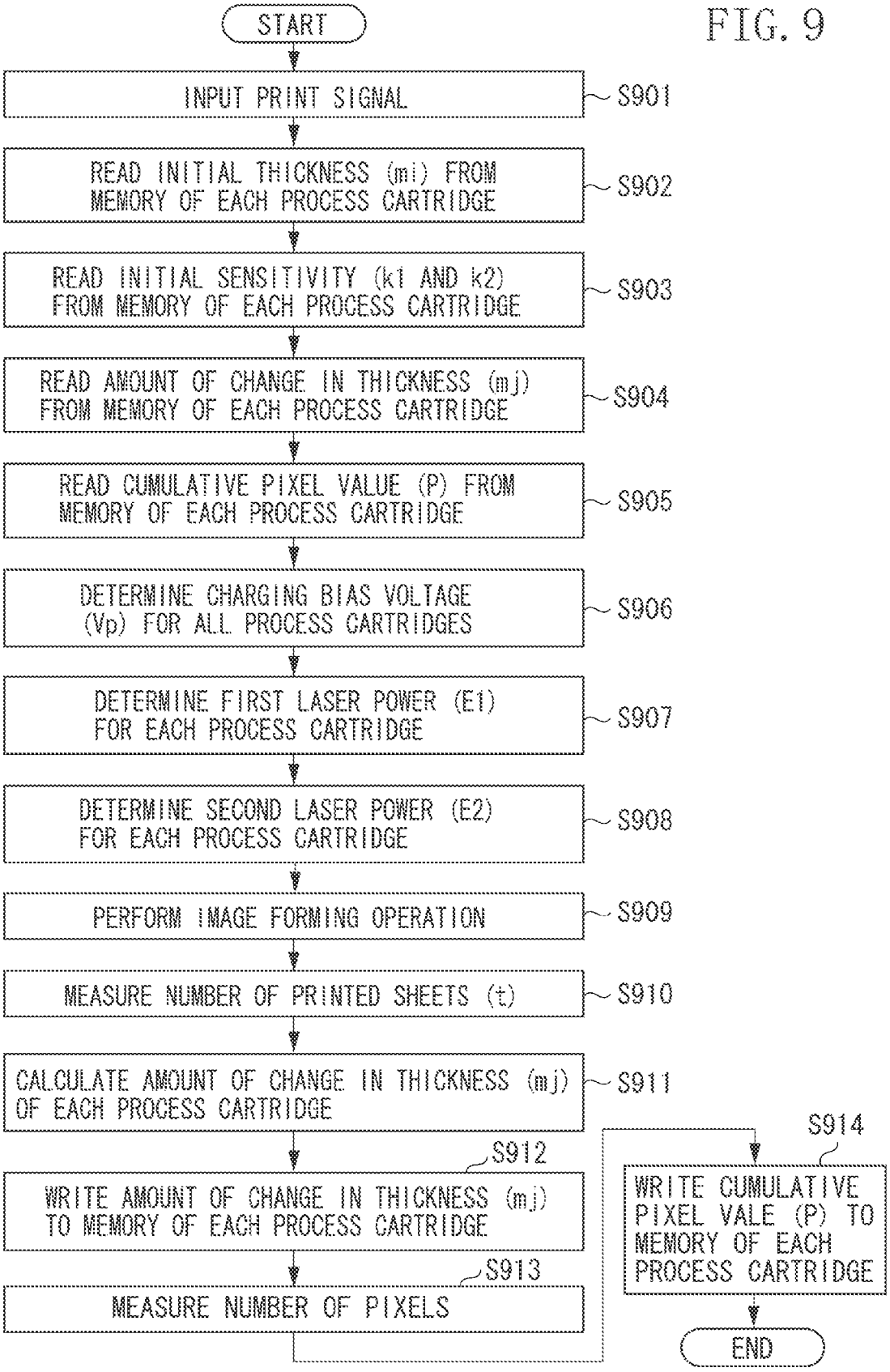
FIG. 9 is a flowchart illustrating a control according to a second exemplary embodiment of the present invention.

Next, a laser power control method according to the present exemplary embodiment will be described with reference to a flowchart of FIG. 9. In step S901, the controller 200 inputs a print signal. The communication unit 101 in the image forming apparatus 1 communicates with the memories 17Y to 17K mounted on the process cartridges 10Y to 10K. In steps S902 to S905, the communication unit 101 reads the initial thickness mi, the initial sensitivity (k1 and k2), the amount of change in thickness mj, and the cumulative pixel value P stored in each of the memories 17Y to 17K. In step S906, the control unit 100 determines the charging bias voltage Vp for all the process cartridges 10Y to 10K based on the equation (Eq. 1). In step S907, the control unit 100 determines the first laser power E1 for each process cartridge 10 based on the equations (Eq. 5) to (Eq. 10). In step S908, the control unit 100 similarly determines the second laser power E2. In step S909, the control unit 100 performs an image forming operation. In step S910, the control unit 100 measures the number of printed sheets t. In step S911, the control unit 100 calculates the amount of change in thickness mj from the measurement result based on the equation (Eq. 2). In step S912, the control unit 100 writes (overwrites) the calculation result to the memory 17 of each process cartridge 10. In step S913, the control unit 100 measures the number of pixels based on image data converted by the image processing unit 103. In step S914, the control unit 100 writes (overwrites) the number of pixels as a cumulative pixel value P via the communication unit 101.

As an example of the foregoing control, an image of A4 size was printed on 10000 sheets at a printing ratio of 5% by using a photosensitive drum 11 having an initial thickness of 18 μm. FIG. 10B illustrates the E-V curve of the photosensitive drum after the printing. With respect to the photosensitive drum 11 having a changed thickness of 13 μm, the control unit 100 set a charging bias voltage Vp=990 V to generate a primary charging potential V0=500 (V). Next, the control unit 100 set the laser powers E1=0.032 μJ/cm$^2$ and E2=0.45 μJ/cm$^2$ to obtain the dark portion potential Vd=450 (V) and the light portion potential Vl=150 (V). As a result, favorable images were obtained over a long period of use. In the second exemplary embodiment, like the first exemplary embodiment, the power supply circuits of the charging bias voltage and the development bias voltage for the process cartridges 10Y to 10K can be shared to provide an image forming apparatus 1 that is small in size and excellent in terms of cost.

An exemplary embodiment of the present invention is not limited to a color image forming apparatus. Similar effects can be obtained even if an exemplary embodiment of the present invention is applied to a single process cartridge. An exemplary embodiment of the present invention is also applicable when the laser powers E1 and E2 have two levels of the exposure amount produced by changing the light emission time in pulse width modulation. The light source is not limited to a laser diode, and an exemplary embodiment of the present invention may be applied even to a light-emitting diode (LED).

The foregoing exemplary embodiments have dealt with a DC charging system where the bias applied to the charging units (charging devices) 12 is a DC voltage. The reason is that the DC charging system is more likely to cause an image defect because of uneven charging. However, an exemplary embodiment of the present invention is not limited to DC charging. For example, an exemplary embodiment of the present invention may be applied to an image forming apparatus of so-called alternating-current (AC) charging system where an AC voltage superposed on a DC voltage is used for charging, provided that the image forming apparatus generates potentials by exposing non-image portions and image portions.

As has been described above, according to an exemplary embodiment of the present invention, it is possible to suppress a drop in the sensitivity of the photosensitive drums 11 while generating stable surface potentials on the photosensitive drum 11.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-113190 filed May 17, 2012, which is hereby incorporated by reference herein in its entirety.

What is claimed is:

1. An image forming apparatus comprising:

a plurality of photosensitive drums;

a plurality of charging devices configured to charge the respective corresponding photosensitive drums, a charging voltage being applied to the plurality of charging devices from a common power supply;

an exposure unit configured to expose surfaces of the plurality of photosensitive drums charged by the charging devices with a first laser power to generate a non-image portion potential, and expose the surfaces with a second laser power to generate an image portion potential;

a plurality of developing members configured to make a developer adhere to an area where the image portion potential is generated to form a developer image on the respective corresponding photosensitive drums, a developing voltage being applied to the plurality of developing members from a common power supply;

a control unit configured to control an intensity of the charging voltage applied to the plurality of charging devices and output of the laser powers of the exposure unit; and an acquisition unit configured to acquire thicknesses of photosensitive layers of the respective plurality of photosensitive drums, wherein the control unit is configured to set the intensity of the charging voltage applied to the plurality of charging devices according to a maximum thickness among the plurality of thicknesses acquired by the acquisition unit, and individually control the output of the first laser power for each of the photosensitive drums according to surface potentials of the respective charged photosensitive drums.

2. The image forming apparatus according to claim 1, wherein the control unit is configured to individually control the output of the second laser power for each of the photosensitive drums according to the surface potentials of each charged photosensitive drum.

3. The image forming apparatus according to claim 2, wherein output values of the first laser power and the second laser power are individually calculated for each photosensitive drum based on the thickness of the photosensitive layer of the photosensitive drum.

4. The image forming apparatus according to claim 3, wherein the output values of the first laser power and the second laser power are individually calculated for each photosensitive drum based on a sensitivity characteristic of the photosensitive layer in addition to the thickness of the photosensitive layer of the photosensitive drum.

5. The image forming apparatus according to claim 4, wherein the output values of first laser power and the second laser power are individually calculated based further on an exposure amount of the photosensitive layers of the photosensitive drums.

6. The image forming apparatus according to claim 5, wherein the exposure amount is calculated based on the number of pixels of an image to be formed.

7. The image forming apparatus according to claim 1, wherein the acquisition unit is configured to calculate the thicknesses of the photosensitive layers based on initial thicknesses of the photosensitive layers and an amount of change in thickness calculated based on a use frequency of the photosensitive drums.

8. The image forming apparatus according to claim 7, wherein the use frequency of the photosensitive drums is calculated based on at least one of the number of times of image formation, the total number of rotations of the photosensitive drums, and an application time of the charging voltage to the charging devices.

9. The image forming apparatus according to claim 1, further comprising a plurality of cleaning members configured to clean the respective corresponding photosensitive drums, wherein at least one of the charging devices, the developing members, and the cleaning members, and the corresponding photosensitive drums are integrally configured as respective process cartridges, and wherein the process cartridges are each configured to be detachably attached to an apparatus main body of the image forming apparatus.

10. The image forming apparatus according to claim 9, further comprising a plurality of storage units configured to store information including at least any one of an initial thickness, a sensitivity characteristic, and a use frequency of the photosensitive layers of the corresponding photosensitive drums, wherein the plurality of storage units are integrally configured with the respective corresponding process cartridges.

11. The image forming apparatus according to claim 1, wherein the control unit is configured to increase an absolute value of the charging voltage as the maximum thickness among the plurality of thicknesses acquired by the acquisition unit becomes greater.

* * * * *